US010563847B2

(12) United States Patent
Jones

(10) Patent No.: US 10,563,847 B2
(45) Date of Patent: Feb. 18, 2020

(54) LAMP FITTING AND ASSEMBLY

(71) Applicant: Design and Deliver, LLC, Charlotte, NC (US)

(72) Inventor: Robert Victor Jones, Charlotte, NC (US)

(73) Assignee: Design and Deliver, LLC, Charlotte, NC (US)

( * ) Notice: Subject to any disclaimer, the term of this patent is extended or adjusted under 35 U.S.C. 154(b) by 39 days.

(21) Appl. No.: 15/968,412

(22) Filed: May 1, 2018

(65) Prior Publication Data

US 2019/0338927 A1 Nov. 7, 2019

(51) Int. Cl.
*F21V 17/06* (2006.01)
*F21V 1/14* (2006.01)
*F21V 1/26* (2006.01)

(52) U.S. Cl.
CPC ..... *F21V 17/06* (2013.01); *F21V 1/143* (2013.01); *F21V 1/26* (2013.01)

(58) Field of Classification Search
CPC ..... F21V 1/14; F21V 1/143; F21V 17/06
See application file for complete search history.

(56) References Cited

U.S. PATENT DOCUMENTS 1,996,584 A * 4/1935 Mateuszczyk ..... F21V 1/14 362/341
2012/0257374 A1* 10/2012 Daniel ..... F21K 9/90 362/84
2017/0027361 A1* 2/2017 Santiago ..... A47G 33/0836

* cited by examiner

*Primary Examiner* — Anabel Ton
(74) *Attorney, Agent, or Firm* — Terrence J. Edwards; TechLaw Ventures, PLLC

(57) ABSTRACT

The disclosure relates to a lamp fitting apparatus system. A system includes a polygonal socket connector comprising a first tapered fitting, wherein the polygonal socket connector is configured to connect with a lamp socket. The system includes a polygonal bracket comprising a second tapered fitting, wherein the polygonal bracket is configured to attach to a lampshade. The system is such that the second tapered fitting of the polygonal bracket corresponds with the first tapered fitting of the polygonal socket connector, such that the polygonal bracket and the polygonal socket connector form a compressing fitting configured to connect the lampshade to the lamp socket.

19 Claims, 18 Drawing Sheets

LAMP FITTING AND ASSEMBLY

STATEMENT REGARDING FEDERALLY SPONSORED RESEARCH OR DEVELOPMENT

Not Applicable

TECHNICAL FIELD

The present disclosure relates generally to lamps and lampshades and more particularly relates to lampshade systems, lampshade fittings, lampshade manufacturing, and lampshade assembly.

DETAILED DESCRIPTION OF PREFERRED EMBODIMENTS

Figure 1:
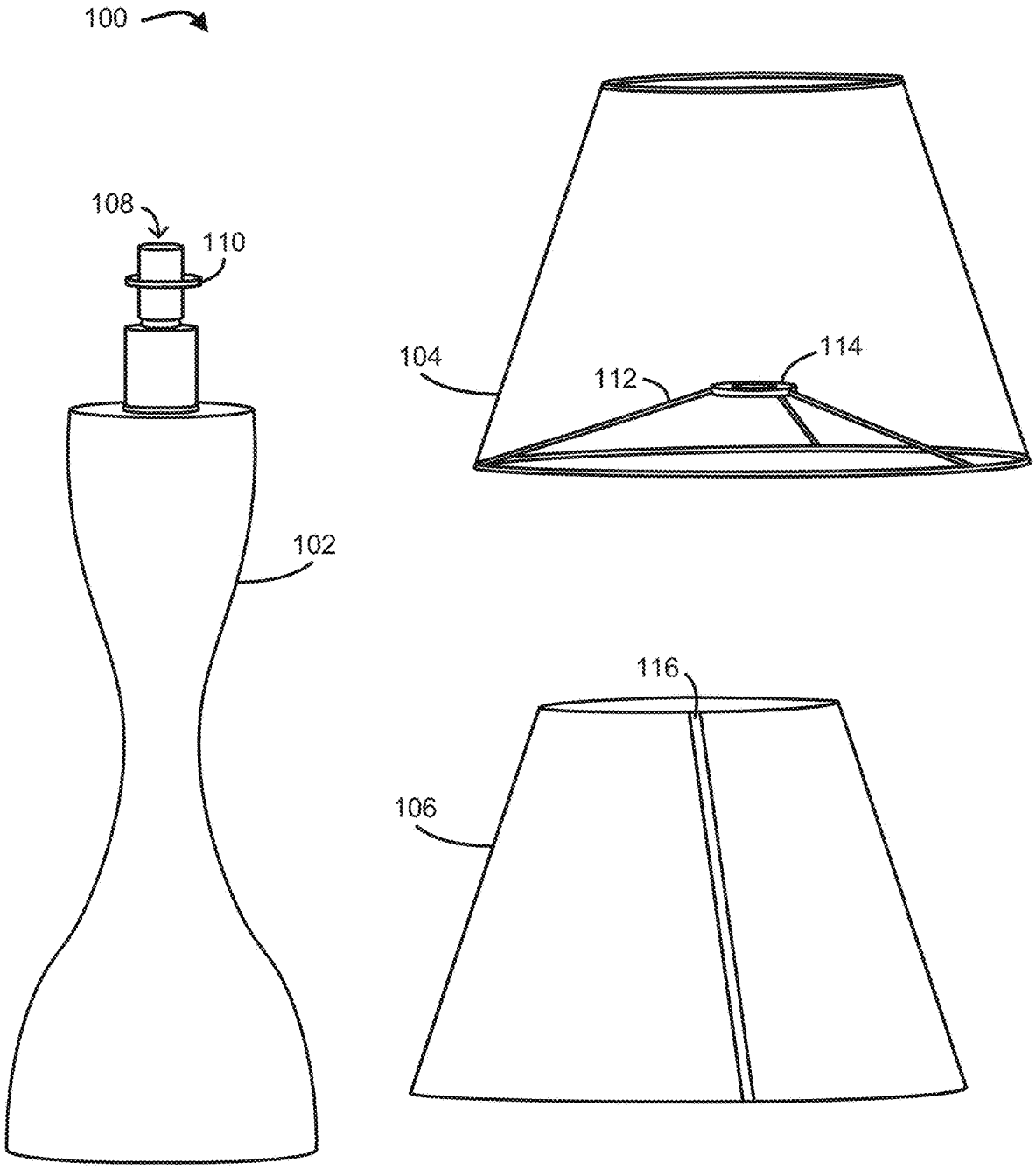
FIG. 1 is a perspective view illustrating components of a lampshade system, according to one implementation.

Lampshades and lamp bases known in the art include many different attachment mechanisms. Thus, because there is no single standard attachment for securing a lampshade to a lamp base, it can be difficult for a user to replace an existing lampshade and keep the same lamp base. This can be desirable in instances where a user wishes to update the appearance of a lamp by replacing the lampshade or where a user wishes to have a variety of lampshade selections for a lamp base.

Applicant recognizes several additional deficiencies with current lampshade attachment mechanisms. For example, current lampshade attachment mechanisms can be wobbly or flimsy when the lamp is adjusted or moved, and such attachment mechanisms can be bent or rendered inoperable if the lamp falls or is otherwise disrupted. Applicant recognizes there is a need for a secure and stable lampshade attachment mechanism. Applicant further recognizes a need for a universal lampshade adaptor providing an attachment mechanism that accommodates a plurality of different lamp bases and lampshades.

Considering the foregoing, Applicant has generated systems, methods, and devices for a lampshade attachment mechanism. The lampshade attachment mechanism can accommodate a plurality of different lampshades and/or lamp bases. Applicant has generated such systems, methods, and devices for providing a secure and stable attachment mechanism that can accommodate bumping and other disturbances without causing significant wobbling in the lampshade or lamp base.

Typically, lampshades are made by laminating fabric to styrene to create a "hardback" surface. The "hardback" material can be connected to a top and bottom ring by "hand" rolling the material over the ring or by adhering the material to a top and bottom ring by tape. Because lampshade vendors require fabric to be laminated, they typically stock 30-50 rolls of material and limit their production to what material they have in stock. Thus, consumers are often limited in what designs and patterns they can choose.

Applicant has recognized several additional deficiencies with the current lampshades and lampshade manufacturing. For example, current lampshades are static and cannot be changed or modified without replacing the entire shade because lamps and lampshades are all uniquely fitted with no universal standard. Some do it yourself lampshade kits exist, but they require the consumer to travel to a fabric store, independently purchase fabric, cut it and apply it to a lampshade base using adhesive paper—resulting in a time consuming and cumbersome lamp/shade combination. Furthermore, consumers have a hard time understanding how and where to buy replacement lampshades because there are too many variables related to the shade/lamp fit.

Applicant has recognized that there is a need for a lampshade assembly system for making decorative elements of lampshades uniquely customizable, interchangeable, and easily replaceable without tools. For example, embodiments disclosed herein may prevent requiring users to purchase an entirely new lamp when they want a new lampshade aesthetic.

Considering the foregoing, Applicant has generated systems, methods, and devices for interchangeable lampshades and/or lampshade covers. Rather than following the current, multi-step process of making lampshades via the traditional process, Applicant has developed systems, devices, processes and methods to create and print designs on materials such as polypropylene, styrene, or other pliable but semi-rigid substrates. For example, substrates may include materials previously used as backing material substrates for fabric lampshades. These substrates allow printing using the capabilities and creativity of a commercial printer.

By using production process and methods disclosed herein, and by standardizing the size of the wraps or shade covers, designs may be printed on digital printers, off-set printers, and cyan, magenta, yellow, and key (CYMK) printers using ultraviolet (UV) inks, glow in the dark inks, three-dimensional printing, and/or and lenticular printing processes. The lampshade covers or wraps are thus only constrained by the type and size of printer used or available for printing the designs. In one embodiment, the wraps or lampshade covers are printed using a printer whose max print images size is 39.5 inches by 28.35 inches (or 997 mm by 720). The substrates and inks may include safe materials, which can be determined based on material safety data sheets (MSDS) for the materials used for the substrate, printed designs, fasteners, or other parts of the lampshade wraps or covers.

Printing directly on rigid or semi-rigid substrates allow for the creation of unique one of a kind designs such as glow in the dark shade wraps, three-dimensional wraps, lenticular wraps, pre-printed wraps, and do it yourself wraps. The unique printing process also allows for fastening the lampshade wraps or hooks using hook and loop (Velcro) tape or matched pole magnetic tape. For example, fabric systems hook and loop materials to be sewn to the shade material whereas fastener in at least some embodiments disclosed herein can be adhered to the substrate using a glue or adhesive.

The systems and methods disclosed herein may enable interchangeable and releasable lampshade covers. Furthermore, manufacturing embodiments may enable affordable design and manufacturing of lampshade covers so that consumers can easily and affordably change out a shade wrap or cover. Packaging methods and configurations are also disclosed, which may reduce shipping and storage volume for manufactures, shippers, and consumers. Consumers may be able to easily interchange and replace lampshade wraps or covers to obtain a new look for a lamp without replacing the lamp and without requiring the use of tools.

A detailed description of systems and methods consistent with embodiments of the present disclosure is provided below. While several embodiments are described, this disclosure is not limited to any one embodiment, but instead encompasses numerous alternatives, modifications, and equivalents. In addition, while numerous specific details are set forth in the following description to provide a thorough understanding of the embodiments disclosed herein, some embodiments may be practiced without some or all these details. Moreover, for clarity, certain technical material that is known in the related art has not been described in detail to avoid unnecessarily obscuring the disclosure.

Turning to the figures, FIG. 1 illustrates views of different components of a lampshade system 100, according to at least one embodiment. The lampshade system 100 includes a lamp body 102, a transparent lampshade 104, and a lampshade cover 106 (also referred to herein as lampshade cover or wrap).

The lamp body 102 may include any shape or size body. For example, the lamp body 102 may have a lower surface or base for resting on a table, the floor or other. As a further example, the lamp body 102 may include a surface or mechanism for attaching to a surface such as a floor, wall, ceiling, table, or other structure. The lamp body 102 supports a lamp socket 108 for receiving a light emitter, such as a bulb or lamp. A supporting ring 110 may support the transparent lampshade 104 or support member relative to the lamp body 102.

In one embodiment, the transparent lampshade 104 acts as a support member to support the lampshade cover 106. The support member may be sized and shaped to support the lampshade cover 106 relative to the lamp body 102 to provide an overall configuration or appearance similar to a conventional lampshade. In one embodiment, the clear or transparent lampshade 104 includes a top and bottom wire to provide structured openings at a top and bottom and a transparent material extends between the top and bottom wires. The wire may be secured to a frame or transparent medium with glue or clear tape, so there will be no visible tape residue when the lampshade cover 106 is placed on the transparent lampshade 104 or support member.

The transparent lampshade includes a euro fitting that includes support arms 112 (e.g., wire) and a ring 114 for resting on the supporting ring 110 of the lamp body 102. The purpose of securing the euro fitting to the base wire is to prevent consumers from seeing support wires when using light colored wraps. The position of the supporting ring 110, support arms 112, and ring 114 below a bulb (e.g., below a top or side of a bulb placed within the lamp socket 108 allows for optimized light projection so that lines or shadows are not present on the lampshade cover 106 when it is placed on the transparent lampshade 104. Furthermore, no shadows from the support members (e.g., transparent lampshade 104, support arms 112, or ring 114) are present on a ceiling or wall when the lampshade system 100 is placed in a room.

The lampshade cover 106 is shown in a lampshade shape with a fastener 116 securing opposing edges of the lampshade cover 106. With the fastener 116 securing the opposing edges, the lampshade cover 106 is in the lampshade shape and may be placed (e.g., dropped or placed from above) on the transparent lampshade 104 or other support member.

The lampshade cover 106 may include at least one of a plurality of semi-rigid materials with a printed pattern and that is cut to fit over the transparent lampshade 104. In one embodiment, no supportive backing is required for the lampshade wrap. For example, the lampshade cover may be formed from a sheet of material that holds a lampshade shape when the fastener 116 is secured. The lampshade cover 106 may be made of any material, such as styrene or polypropylene, with sufficient thickness or strength to provide the needed rigidity.

The cooperating detachable fastener(s) 116 may be positioned on opposing ends of each lampshade cover 106. Each detachable fastener 116 may be any fastener known in the art for fastening or removably securing one object to another including, for example, standard push-button snaps, hook and loop (e.g., Velcro) fasteners, adhesive substances, glues, combinations thereof, and the like. It should also be noted that the detachable fasteners 116 may be configured in any array and/or number, so long as the fasteners function in accordance with the present invention as described herein. The detachable fasteners 116 on opposing ends facilitate the lampshade cover 106 to be rolled up into a cylindrical tube, in a storage configuration, during storage and transportation, and subsequently unrolled to an operative configuration for wrapping the lampshade cover 106. The lampshade shape configuration may have a top diameter that is smaller than the bottom diameter, as illustrated in FIG. 1. The lampshade cover 106 will be dimensioned and adapted to be placed on top of the transparent lampshade 104 to be maintained in a lampshade position over the lamp body 102 and any bulb.

Figure 2:
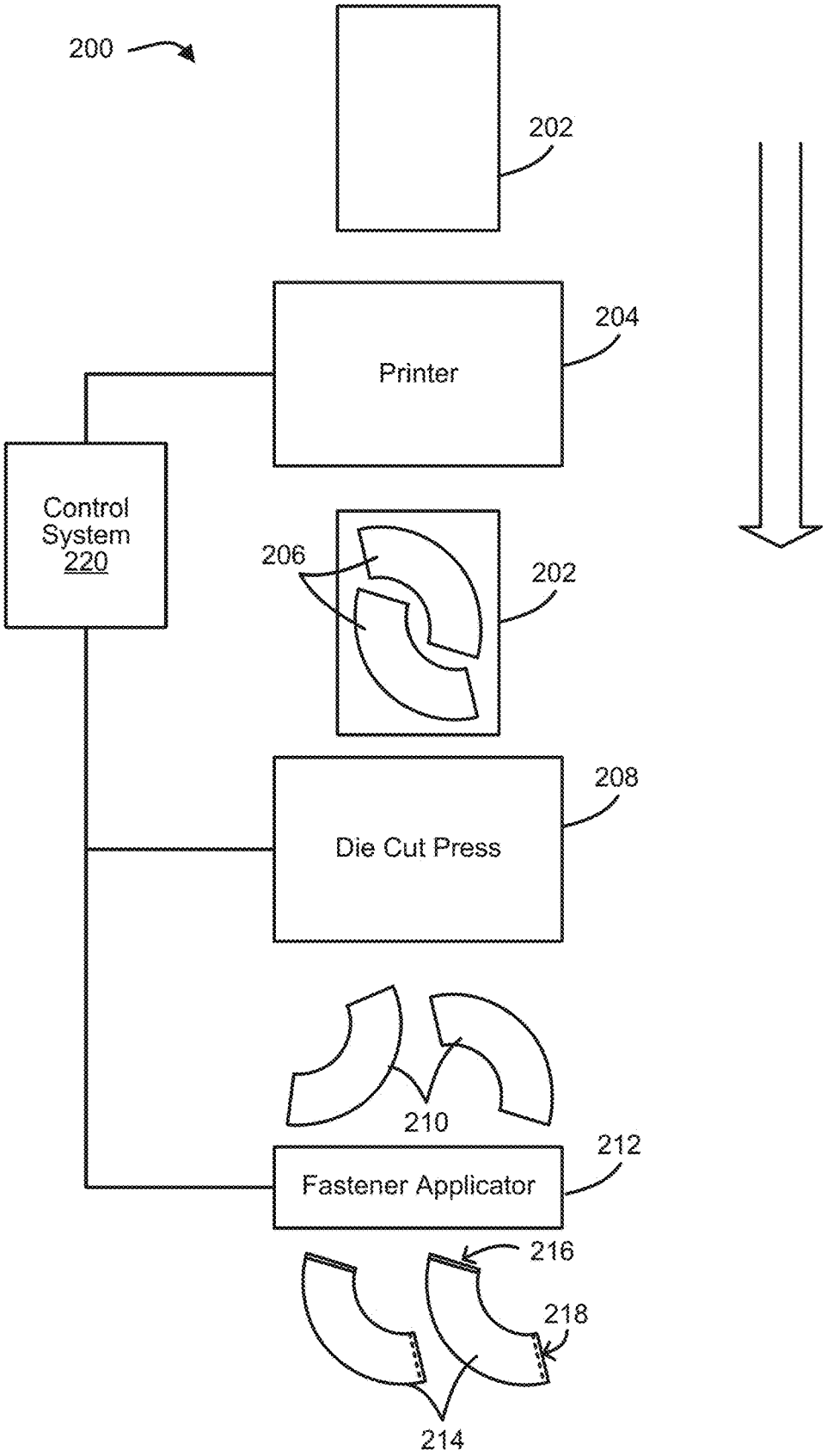
FIG. 2 is a schematic block diagram illustrating a process for manufacturing a lampshade cover, according to one implementation.

FIG. 2 is a schematic diagram illustrating a process 200 for manufacturing a lampshade cover. The process 200 begins and a sheet 202 of semi-rigid material is fed into a printer 204. In one embodiment, the sheet 202 include a sheet of polypropylene, styrene or other plastic material. In one embodiment, the sheet 202 may include a thickness that allows the sheet 202 to bend in a direction normal to its surface but prevents bending or deforming in a direction parallel to the surface. In one embodiment, the sheet 202 includes a thickness of about 0.25 mm or greater. In one embodiment, the sheet 202 includes a thickness of about 0.25 mm to about 0.55 mm. In one embodiment, the sheet 202 has a thickness form about 0.35 mm to about 0.45 mm. The thickness of the sheet may vary based on material type, the graphic depiction, design and desired look and effect, expected temperature when mounted on a lamp, or the like to provide a lampshade cover that can hold its shape in a lampshade shape.

The sheet 202 may be opaque, transparent, or semi-transparent. The sheet 202 may have a frosted or other obscuring finish so that it is not fully transparent but allows some amount of light to pass through. A semi-transparent sheet 202 or frosted finish may allow some light to pass through without allowing excessive brightness or glare in a user's eyes. The sheet 202 may be fully transparent and some opacity may be provided by a design printed on the sheet 202. The sheet 202 may be sized to be accommodated by the printer 204. For example, commercial printers with a large printing size may be used to allow for designs and patterns large enough to form a lampshade cover may be used.

The printer 204 prints a design 206 or pattern on the sheet 202. The printer 204 may print any design 206 using any known printing process. According to one embodiment, special printing processes may be used for printing on non-porous material such as plastic materials. Example printing processes may be used including ultraviolet (UV) printing, lenticular printing, or the like.

In one embodiment, the printer 204 prints a design using a UV printing process. UV printing is different from conventional printing in many ways. Instead of having solvents in an ink that evaporate into the air and absorb into paper (or other substrate), UV inks, pastes, or powders dry through a photomechanical process. When the inks are exposed to ultraviolet radiation they turn from a liquid, or paste, to a solid. There is significantly less evaporation of solvents and much less absorption of the ink into the stock.

This is advantageous for many reasons. One of the biggest advantages of UV printing is that there are fewer emissions of volatile organic compounds into the environment since there is no evaporation of the solvents like with conventional inks. Another advantage of UV printing is that the inks can dry on plastic and other non-porous substrates, such as a sheet 202 made of a non-porous plastic. Because the inks dry through a photomechanical process it is not necessary for the ink solvent to absorb into the stock. Basically, if you can get the stock or sheet 202 through the printer 204 you can print on it. This process is different than printing on fabrics and laminating the fabric to a hard surface like typical lampshade manufacturing.

In addition to the advantage of printing on unusual substrates like plastic, UV printing also offers significant advantages when printing on uncoated stocks as well. The solvents in conventional inks absorb very quickly into uncoated stocks. Because of this, less of the solvents evaporate into the air and the printed piece tends to have excessive dot gain and will look muddy or too full. Since UV inks dry when exposed to UV light, the inks do not have the time to soak into the paper. The ink dot is left sitting on top of the uncoated sheet, where it presents a cleaner less contaminated dot, ultimately giving more vibrant color.

The key to printing with UV inks successfully lies in exposing the UV ink to enough ultraviolet energy to cure the ink while not making the substrate too brittle and also achieving an acceptable level of adherence to the substrate. This is extremely difficult because every different substrate has very different characteristics.

In one embodiment, the printer 204 is used to print on a surface that will not be exposed. This may be the case, for example, when the sheet 202 is made of a transparent or semi-transparent material that allows the design to be seen from the opposite side. In some cases, the design may be laminated with a clear thin film or gloss to protect the design from being scratched off or to provide a finish for a desired aesthetic or appearance.

The printer 204 may print a design 206 using CMYK inks to provide full color and high quality appearance and design. In some cases, almost any desired appearance can be achieved due to high dot-per-inch printing. In one embodiment, the printer 204 applies a glow in the dark ink or powder as part of the design. For example, a glow in the dark lampshade cover may be printed using an UV glow in the dark ink with a gloss varnish. The glow-in-the-dark material may be applied over a full surface of the design 206 or may be spot printed to provide a glow-in-the-dark effect only at specific locations. In one embodiment, a combination of glow-in-the-dark and CMYK printing may be performed to provide both color and glow-in-the-dark effects to a design 206.

Glow-in-the-dark or glowing effects may be achieved using luminescent or florescent materials. Luminescent material absorbs energy and emits this as light. This can happen either immediately or over a period of time, such as after a light source is turned off. This light emission, or excitation energy, is called luminescence and does not contribute to the thermal energy of the compound.

Fluorescence is the light emitted from a material when it is exposed to exciting energy or electromagnetic radiation. It is a form of luminescence. Fluorescence also occurs frequently in nature in some minerals and in various biological states in many branches of the animal kingdom. Phosphorescence is the glow in the dark light or afterglow that can be detected by the human eye after the cessation of excitation. Lumens is the unit of luminous flux in the International System, equal to the amount of light given out through a solid angle by a source of one candela intensity radiating equally in all directions. Lumens are used to measure light bulbs as standalone light sources while lighting fixtures are measured by Lux output, also known as lumens per square meter. Typically used to measure the light intensity produced by a lighting fixture. The higher the Lux reading the more light the lighting fixture is producing over a given area. See German norm Din 67510 "Photoluminescent pigments and products—Part 1: Measurement and marking at the producer", ASTM Committee E12.13 "Photoluminescent Safety Markings", ASTM E 2073-00, and ASTM E 2030-99 for measurement of photoluminescent properties and safety markings made from photoluminescent materials In one embodiment, the printer 204 prints a design using a lenticular process. In lenticular printing, two or more different images are loaded into a computer graphics program. By way of example, two images may be used. The program cuts each image into dozens of thin strips and weaves them together so the strips from the first image alternate with the strips from the second. This process is called interlacing. This interlaced images is printed and a transparent plastic layer is printed/placed on top of the interlaced or doubled-up image. The transparent plastic layer is made of dozens of separate thin, hemi-spherical lenses called lenticles. These refract (bend) the light passing through them so that a viewer sees only half (or some other number) of the printed strips. If the user moves their head back and forth the image flips back and forth too like a kind of visual see-saw.

Each one is a hemispherical plastic lens that magnifies only one of the sliced images underneath it, depending on where the viewer's eyes are in relation to the printed image. Different lenticulars have what's called a different pitch, which is the number of lenticles per inch (LPI). They also work differently at different distances from the viewer. Both these factors—the pitch and the viewing distance—should be considered to make a convincing lenticular print.

For all this to work properly, everything should be printed with incredible precision. The lenticles must be lined up with the underlying images strips. Additionally, the image may need to be adjusted and printed so that it looks exactly right when viewed through a certain piece of lenticular plastic (with a certain "pitch"—or number of lenticles per inch) at a certain viewing distance. In theory, you can show many different images with a lenticular: you could have half a dozen different images, all designed to point in slightly different directions, so that the lampshade cover changes its appearance as a viewer moves relative to the lampshade cover. Lenticular printing may also be used to create three-dimensional holographic images. Furthermore, an appearance of movement can be achieved because the image changes as the viewer moves.

In one embodiment, the printer 204 may perform an additive three-dimensional printing on the sheet 202. For example, shapes that extend upward from the sheet 202 may be built or printed by a 3D printer. Because the designs 206 are meant to be bent or rolled when a lampshade cover is in a lampshade shape, there may be limit on the thickness and/or length/width of 3D feature. However, a desired appearance or texture may be imparted to a design 206 with the help of three dimensional features.

The use of glow in the dark, lenticular printing, and/or 3D printing may allow for designs and appearances not previously possible using fabric materials as the medium for displaying a design for a lampshade cover.

A die cut press 208 cuts out the design 206 from the sheet 202 to produce cut-out portions 210. These cut out portions may have the dimensions desired to form a lampshade, when they are bent and/or rolled into a lampshade configuration or shape. The die cut press 208 may allow for fast and efficient production of lampshade covers because printing may be performed on a sheet 202, which is easier to for a printer 204 to work with and perform accurate printing than an oddly shaped lampshade cover or cut out versus the traditional approach of printing hundreds of yards of fabric and sending it to a laminator to apply the "hard backing" needed to stabilize the material.

A fastener applicator 212 applies and/or attaches fasteners to the one or more cut-out portions 210 to produce one or more lampshade covers 214. The fastener applicator 212 applies or attaches the fasteners to a first end 216 and a second end 218 of the cut-out portion 210. With the fasteners in place, the lampshade covers 214 are in a flattened configuration but may be bent to match the first end 216 and second end 218 to place the lampshade covers 214 in a lampshade shape or lampshade cover configuration.

The fastener applicator 212 may apply any type of fastener such as a hook and loop fastener, buttons and corresponding loops, zippers, magnetic tape, tongue and groove inter-locking cut outs, or the like. In one embodiment, the fastener applicator 212 may attach the fasteners using a glue or adhesive. For example, matched pole magnetic tape may be applied to each of the first end 216 and second end 218. Similarly, a hook and loop fastener (such as Velcro®) may be attached using a tape adhesive or glue. Because the lampshade covers 214 are formed of a plastic, adhesives and glue may provide sufficient bonding strength. With fabrics, sewing or other more expensive or complicated attachment process may have been necessary. Specifically, because, in one embodiment, printing and fastener attachment is performed on a plastic substrate, an adhesive backed fastener may be used. The ease of applying an adhesive backed fastener can reduce production costs for the end consumer, leading to the ability to exchange and/or dispose of lampshade covers 214, in one embodiment.

In one embodiment, a control system 220, which may include a computing system, controls operation of the printer 204, die cut press 208, and/or fastener applicator 212. This can allow for on-the-fly configuration of designs with little or no human manipulation of sheets 202, cut-outs with designs 206, or lampshade covers 214. For example, consumers may remotely select lampshade cover configuration, design, and other aspects that can be automatically configured and implemented by the control system 220. For example, the control system 220 may load a different design to be printed by the printer 204, configure a different size for the die cut press 208, and/or configure a different fastener or application process for the fastener applicator 212. For designs, for example, users may upload or modify designs for upload to the control system 220 via a cloud interface or the Internet.

Figure 3:
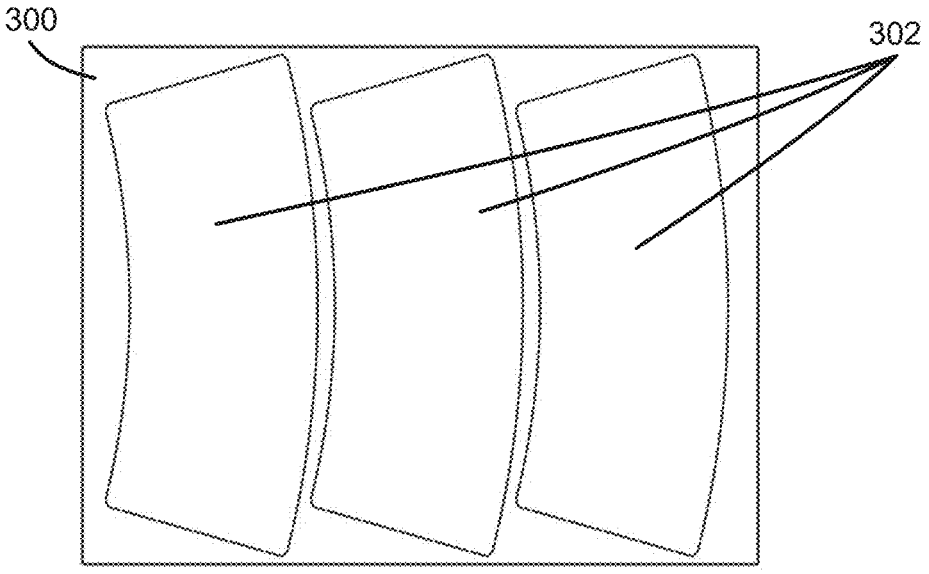
FIG. 3 is a plan view illustrating a layout for cut-out shapes for lampshade covers on a sheet of material, according to one implementation.
Figure 4:
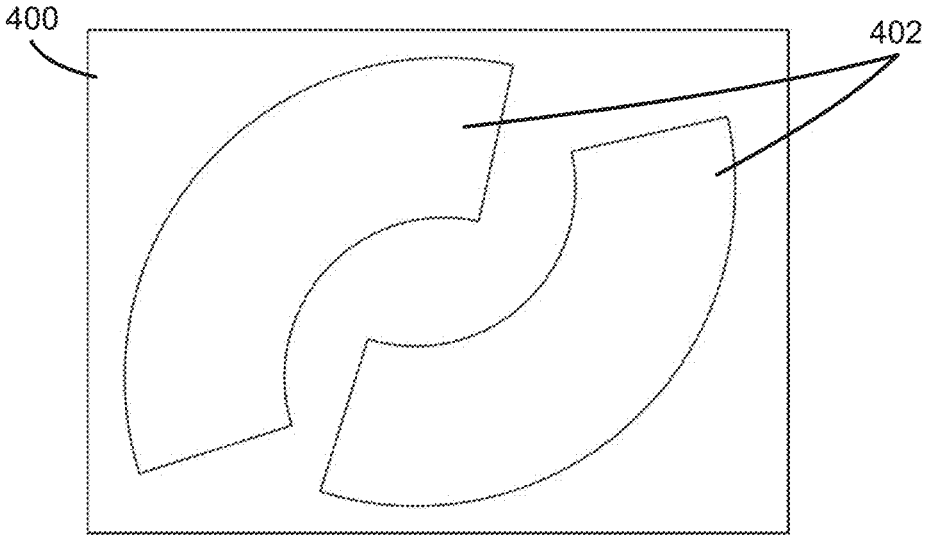
FIG. 4 is a plan view illustrating another layout for cut-out shapes for lampshade covers on a sheet of material, according to one implementation.

FIG. 3 illustrates a sheet 300 with a layout of cut-out shapes 302 according to one embodiment. FIG. 4 illustrates a sheet 400 with a layout of cut-out shapes 402 according to another embodiment. It should be noted the layout for FIG. 3 fits three cut-out shapes 302 for three lampshade covers while FIG. 4 fits two cut-out shapes 402 for two lampshade covers.

The lampshade covers after the process of FIG. 2 may be in a flattened configuration. The flattened configuration may allow for extremely dense storage, which may allow for reduced storage and shipping costs. For example, conventional lampshades are large and extend into three dimensions, but the lampshade covers in the flattened configuration are largely two-dimensional and thus can be stacked in a much more compact matter. Flattened configurations may be conducive to shipping large numbers of lampshade covers in the same container or box. For individual shipping of lampshade covers or shipping a small number of lampshade covers. The flattened configuration may be undesirable. For example, if a lampshade cover is sold in a single pack or a triple pack, the dimensions of the flattened configuration may be undesirable. In one embodiment, lampshade covers may be individually packaged or packaged in small numbers by rolling up each lampshade cover. This reduces the horizontal dimensions of the lampshade cover.

Figure 5:
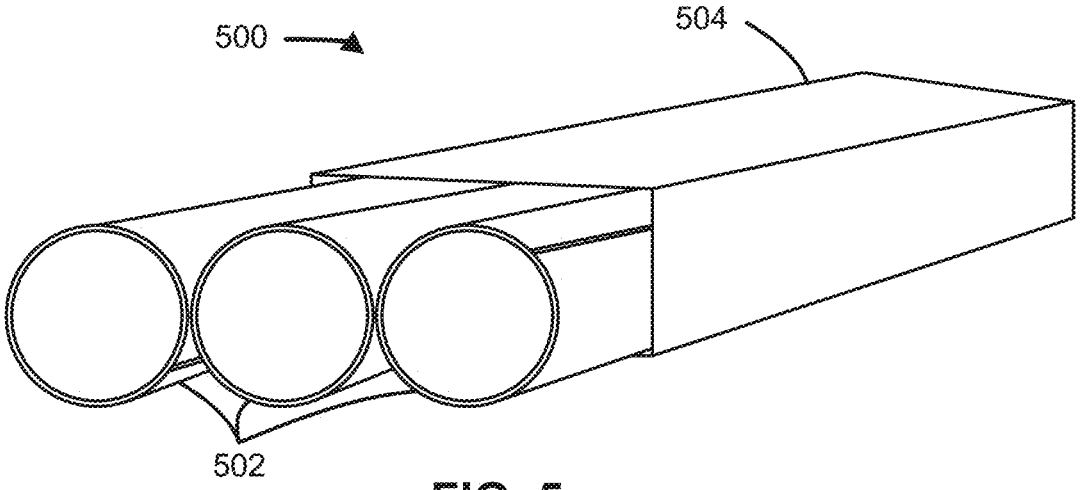
FIG. 5 is a perspective view illustrating packaging of three lampshade covers in a container, according to one implementation.

FIG. 5 is a perspective view illustrating packaging 500 of three lampshade covers 502 in a container 504. The lampshade covers 502 are rolled up (similar to a rolled-up paper) and inserted side by side into the container 504. The container 504 is a rectangular box that accommodates all three lampshade covers 502. The packaging 500 allows for a small shipping profile. A cap or lid may also be included. In one embodiment, the cap or lid is reusable to that the container 504 can be used by a consumer for storage when a lampshade cover 602 is not in use.

Figure 6:
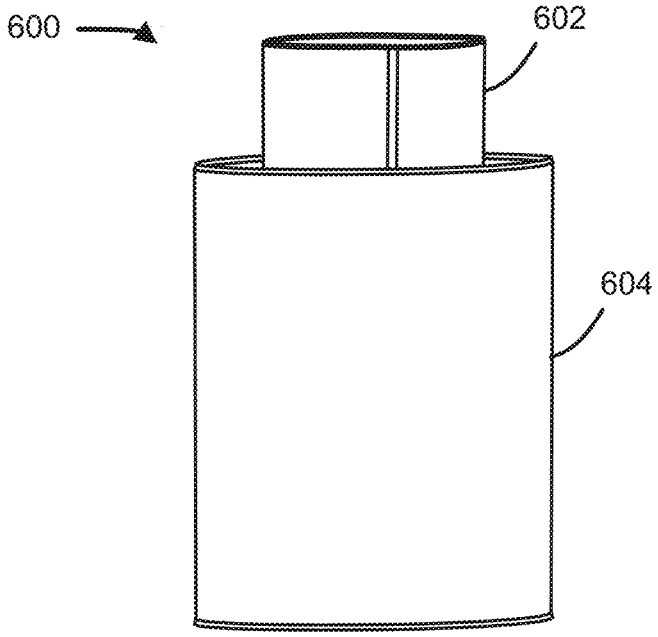
FIG. 6 is a perspective view illustrating packaging of a lampshade cover in a container, according to one implementation.

FIG. 6 is a perspective view illustrating packaging 600 of a single lampshade cover 602 in a container 604. The lampshade cover 602 is rolled up and inserted into the container 604. The container 604 is a cylindrical tube that accommodates the lampshade cover 602. The packaging 600 allows for a small shipping profile. In one embodiment, the cap or lid is reusable to that the container 604 can be used by a consumer for storage when a lampshade cover 602 is not in use. For example, the lid may include a plastic pop off cover.

Because the lampshade covers 502, 602 are formed from sheets thin enough to bend, they may be rolled in the manner illustrated. However, the lampshade covers 502, 602 are also thick enough to provide rigidity as a lampshade. In one embodiment, a design is printed on an interior surface of the lampshade covers 502, 602 to avoid scraping or scratching the design during packaging, shipping, and/or installation. In one embodiment, the design can be seen from an exterior surface due to a transparent or semitransparent substrate. In one embodiment, the design is opaque or semi-transparent to avoid glare from shining through the lampshade covers 502, 602 when installed.

Decorative lampshade wraps or covers may only take the shape, form and function of a lampshade after they have been purchased, received and removed from the delivery tube. In one embodiment, lampshade wraps or covers may be re-rolled and stored in the delivery tube when not in use or when being displaced by another wrap.

Figure 7:
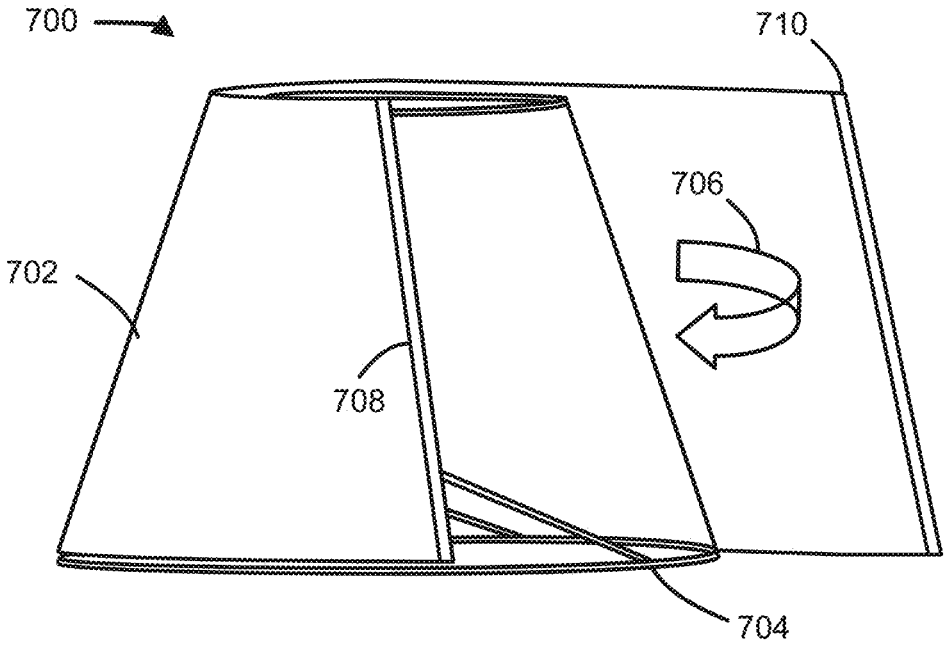
FIG. 7 is a perspective side view of illustrating installation or application of a lampshade cover to a transparent lampshade, according to one implementation.

FIG. 7 is a perspective side view a lampshade system 700 showing installation or application of a lampshade cover 702 to a transparent lampshade 704 to create the lampshade system 700 for use on a lamp, according to one embodiment. The lampshade cover 702 may be wrapped around the transparent lampshade 704 as indicated by arrow 706. A fastener 708 on a first end and a fastener 710 on a second end may be attached to complete installation. The fasteners 708, 710 may include any type of fasteners such as hook and loop fasteners, magnetic tape, or the like. Once the fasteners 708, 710 are secured, the lampshade cover 702 may be supported by the transparent lampshade 704 to provide the lampshade 700 having the appearance similar to a conventional lamp shade.

As will be clear in light of the disclosure, a large number of different types of dimensions and shapes may be achieved and is not limited to the illustrated shape. In one embodiment, the lampshade cover 702, with the fasteners 708, 710 attached, may be rigid enough to support its own weight in a lampshade configuration. Thus, exact matching between the transparent lampshade 704 or other support member may not be required as long as a lower edge or other portion of the lampshade cover 702 is supported by the transparent lampshade 704 or other support member. In the embodiment depicted in FIG. 7, the lampshade cover 702 matches a shape of the transparent lampshade 704 and the fasteners keep the lampshade cover 702 from sliding downward off the transparent lampshade 704. In other embodiments, a transparent lampshade 704, or other support member may provide a lip or groove to receive a lower edge of the lampshade cover 702.

Figure 8:
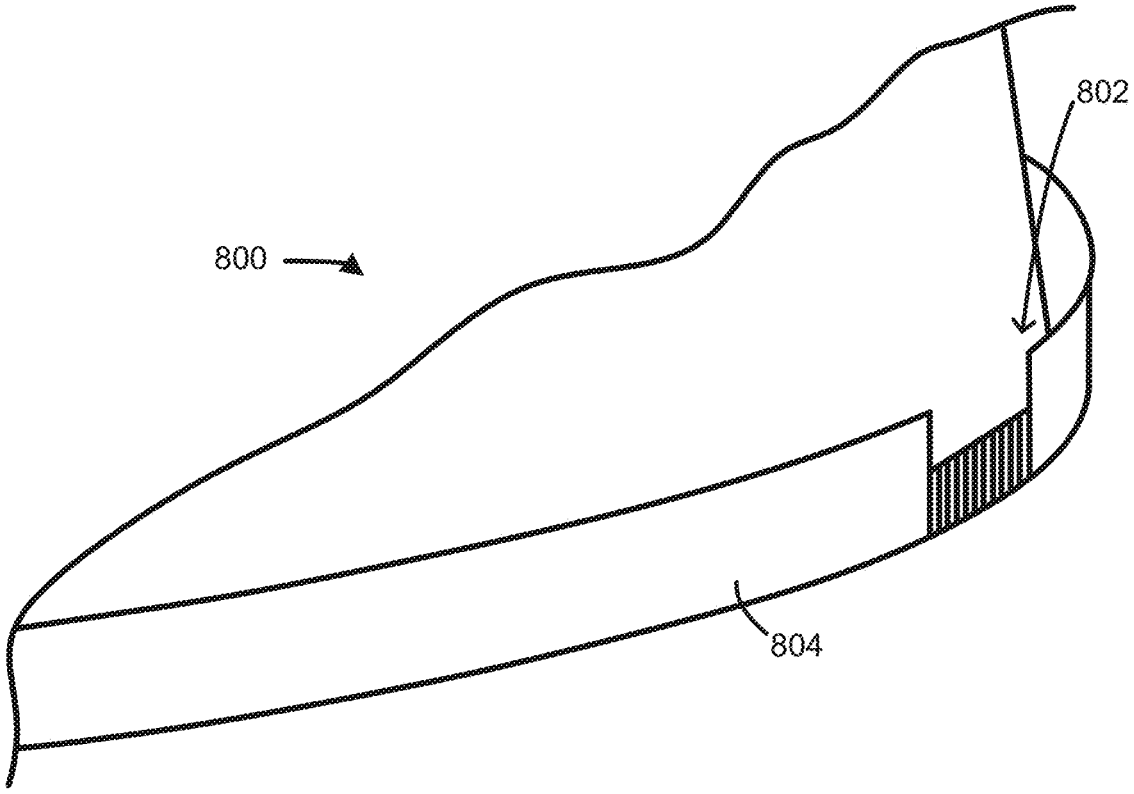
FIG. 8 is an enlarged perspective view of a base of a transparent lampshade having a channel or groove for receiving a lower edge of a lampshade cover, according to one implementation.

FIG. 8 is an enlarged perspective view of a base of a transparent lampshade 800 having a channel or groove 802 for receiving a lower edge of a lampshade cover, according to one embodiment. The channel or groove 802 provides a gap between the transparent lampshade 800 and a lip 804. The lip 804 may extend from a base wire or ring so that there is a groove for receiving the lower edge of a lampshade cover or wrap. In one embodiment, the lip 804 is formed of a cloth, rigid plastic, metal, or other material. In one embodiment, the lip 804 extends about ¼ of an inch away from the base of the transparent lampshade 800.

Figure 9:
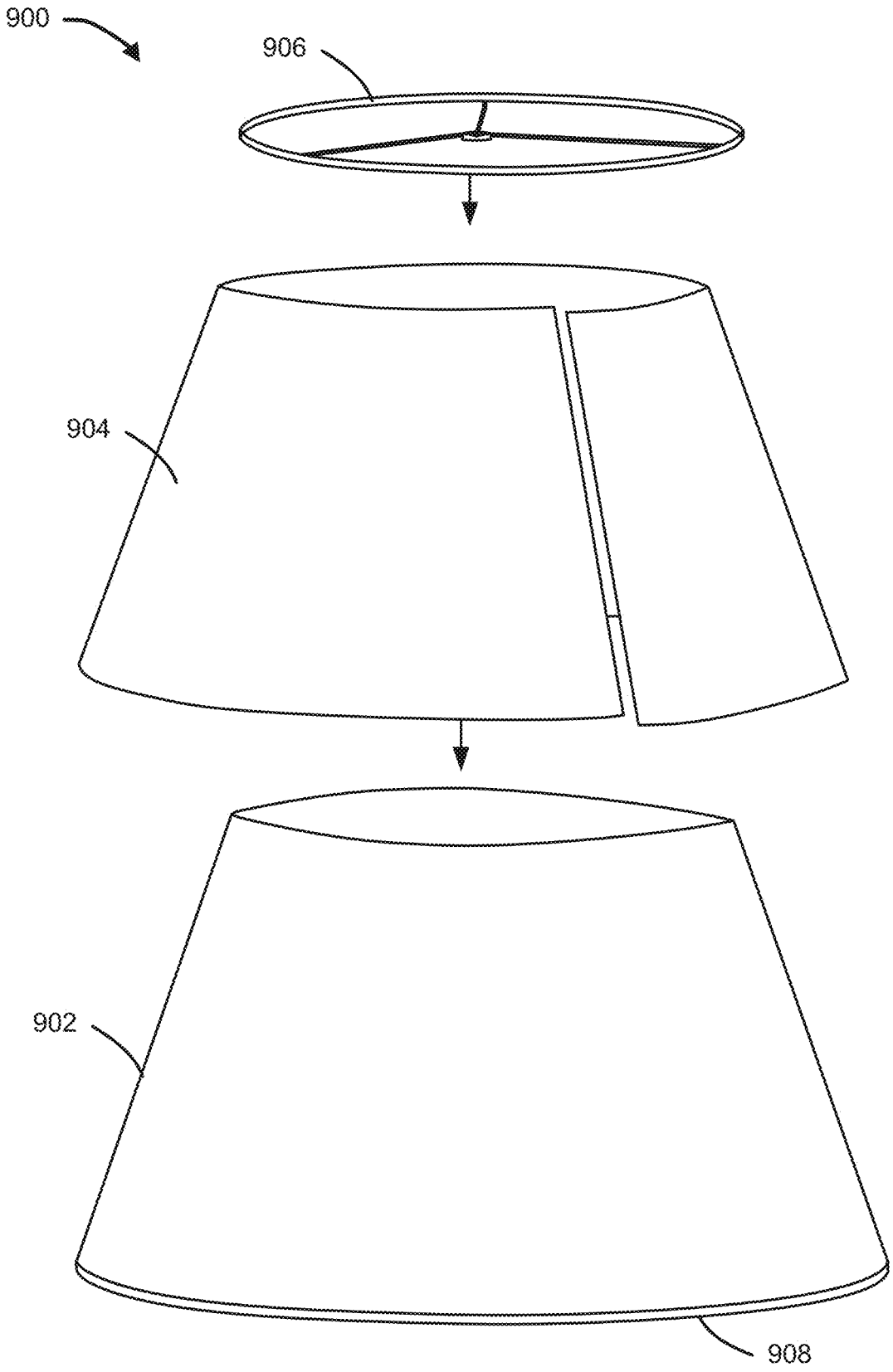
FIG. 9 illustrates an exploded view of a lampshade system, according to one embodiment.

FIG. 9 illustrates an exploded view of a lampshade system 900, according to one embodiment. The lampshade system 900 includes a transparent lampshade base 902, a lampshade cover 904, and an upper support ring 906. The lampshade base 902 includes a lower lip 908 for accommodating a lower edge of the lampshade cover 904 and the upper support ring 906 may also include a lip for extending over an upper edge of the lampshade cover 904. The lampshade system 900 may be assembled with any lampshade cover 904 having a desirable pattern or design. The lampshade system 900 may be assembled by attaching the ends of the lampshade cover 904, dropping the lampshade cover 904 over the transparent lampshade base 902, placing the upper support ring 906 over the upper edge of the lampshade cover 904 and transparent lampshade base 902, and securing the upper support ring 906 in place using clips rivets, or other fasteners.

In one embodiment, embodiments and systems disclosed herein may be used with standardized sizes. For example, lamps, lampshade covers, and support members (e.g., transparent lampshades) may be manufactured and labeled in a plurality of predetermined sizes; for example, small, medium, large, kid sizes, and the like. In one embodiment, a lampshade system may provide a systemic lampshade frame having peripheral top and bottom flanges dimensioned and adapted to secure a systemic shade wrap or cover without tools, such as that illustrated in FIGS. 8 and 9. The lampshade system may include a color-coded format or a logo and branding format allowing users to easily identify the predetermined size of the plurality of components of the lampshade wrap or cover system.

A consumer may be able to select and or design a desired lampshade system using a computing system or electronic interface. For example, a consumer may select a size for a lampshade cover and then select a design or pattern to be printed on the lampshade. Based on the selections, a manufacturing system (such as the components in FIG. 2) may perform a manufacturing process to produce a customized lampshade wrap.

Figure 10:
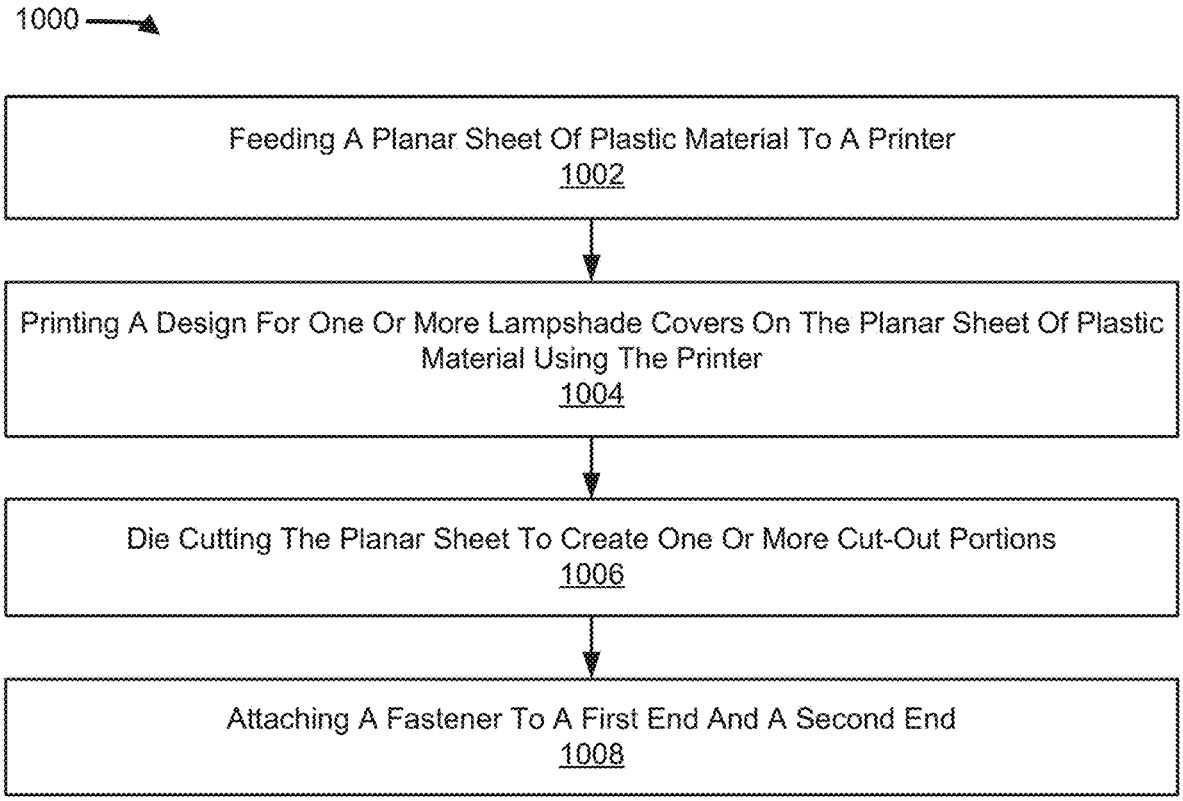
FIG. 10 is a schematic flow chart diagram illustrating a method for manufacturing a lampshade cover or wrap, according to one embodiment.

FIG. 10 is a schematic flow chart diagram illustrating an example method 1000 for manufacturing a lampshade cover or wrap. The method 1000 may be performed by a manufacturing system, such as the printer 204, die cut press 208, fastener applicator 212, control system 220 of FIG. 2. The method 1000 begins and a roller or feed system feeds at 1002 a planar sheet of plastic material to a printer. The printer prints at 1004 a design for one or more lampshade covers on the planar sheet of plastic material. A die cut press cuts at 1006 the planar sheet to create one or more cut-out portions shaped to be bent, folded, or rolled into a three-dimensional lampshade cover shape. The cut-out portions including at least a portion of the design printed using the printer. A fastener applicator attaches at 1008 a fastener to a first end and a second end for selectively fastening the first end to the second end to hold the cut-out portions in the three-dimensional lampshade cover shape.

Figure 11:
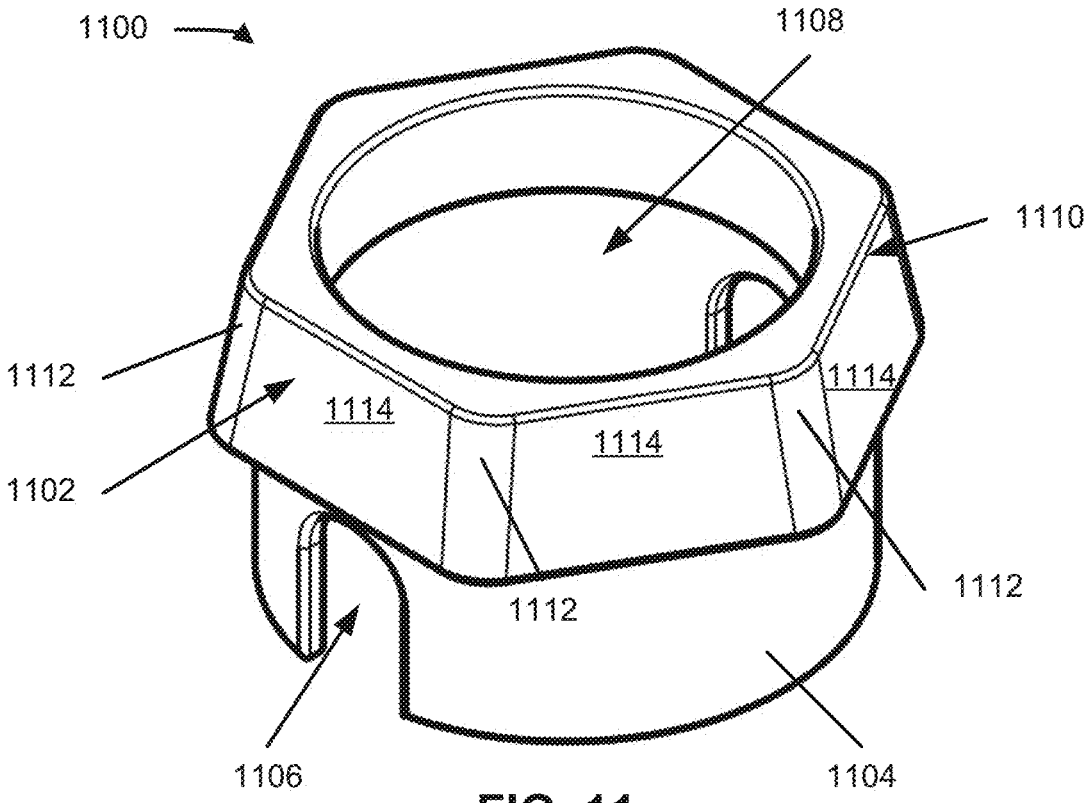
FIG. 11 is a perspective view illustrating a polygonal socket connection, according to one embodiment.
Figure 12:
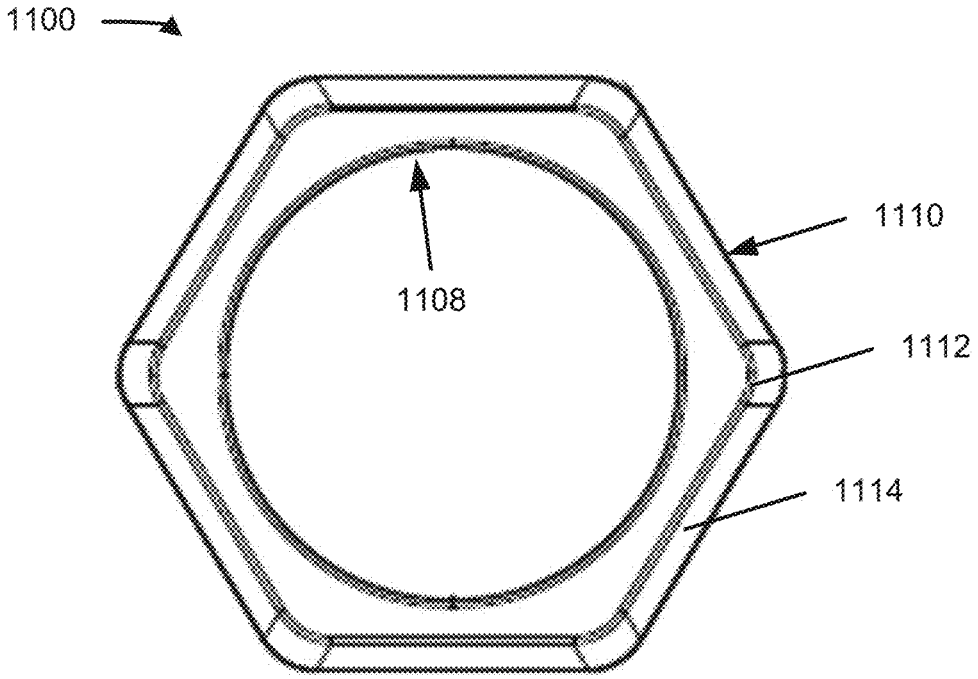
FIG. 12 is an aerial view illustrating a polygonal socket connection, according to one embodiment.
Figure 13:
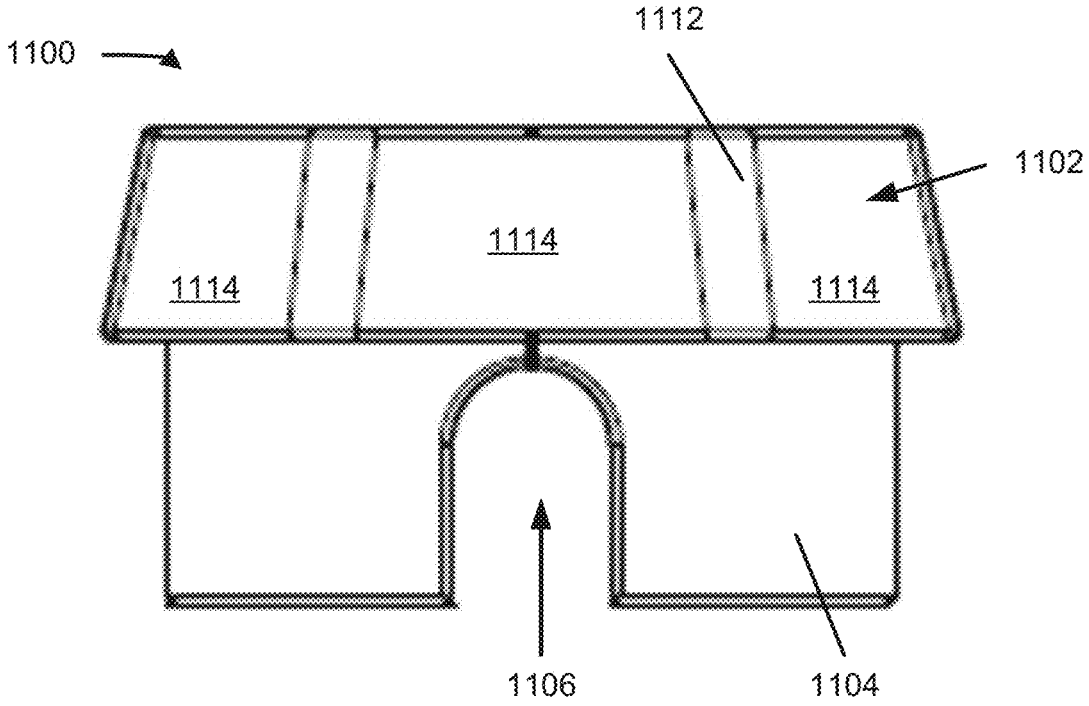
FIG. 13 is a front view illustrating a polygonal socket connection, according to one embodiment.
Figure 14:
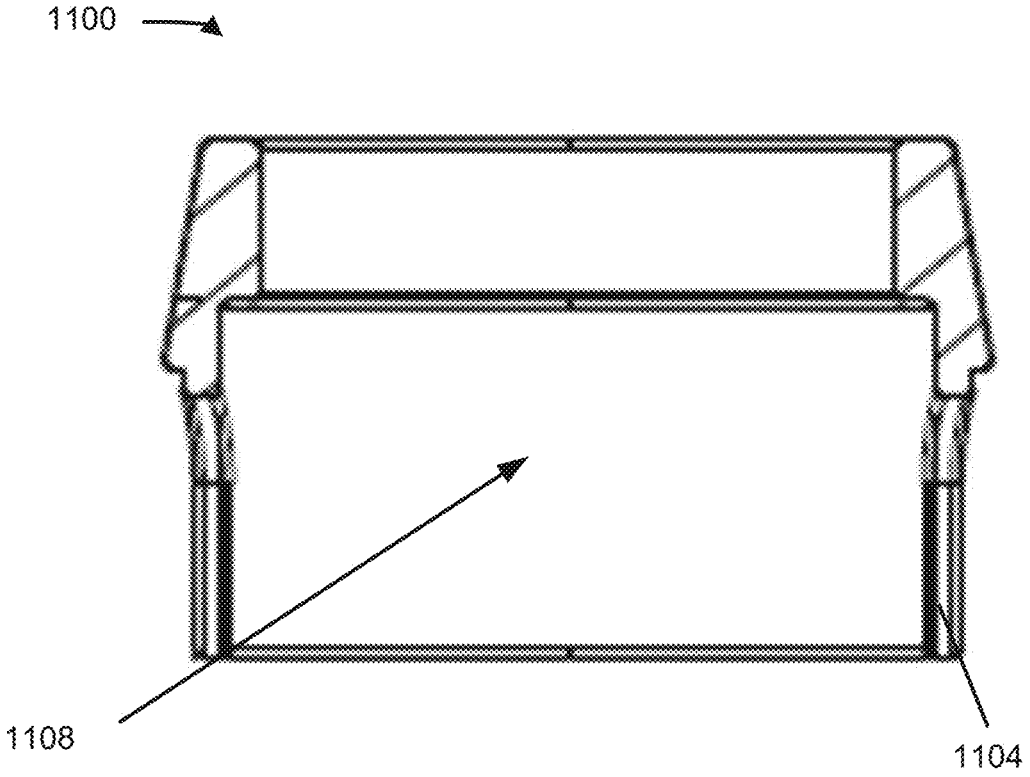
FIG. 14 is a cross-section view illustrating a polygonal socket connection, according to one embodiment.

FIGS. 11-14 illustrate various views of a polygonal socket connector 1100, according to one embodiment. FIG. 11 illustrates a perspective view, FIG. 12 illustrates an aerial view, FIG. 13 illustrates a front/side view, and FIG. 14 illustrates a cutaway front/side view wherein one-half of the polygonal socket connector 1100 has been cut away and interior portions of the device are illustrated. The polygonal socket connector 1100 includes an interior surface 1108 and an exterior surface 1110. The polygonal socket connector 1100 includes a first tapered fitting 1102 disposed about the exterior surface 1110. In an embodiment as illustrated, the first tapered fitting 1102 comprises a plurality of tapered sides 1112, 1114 located on each of a plurality of sides. The polygonal socket connector 1100 includes a channel 1106 located within a sleeve 1104.

The polygonal socket connector 1100 is configured to connect with a lamp socket (see 2200 and 2300). In an embodiment, the polygonal socket connector 1100 rests on the socket or forms a compression fitting with the socket. In an embodiment, the channel 1106 is configured to receive and rest on an electrical fitting (see 2204, 2304) of the socket. The electrical fitting includes, for example, a knob, a pull, a button, and so forth for activating or deactivating the lamp. In an embodiment, the size and shape of the interior surface 1108 of the sleeve 1104 is configured to tightly receive the socket. In an embodiment, the size and shape of the interior surface 1108 of the sleeve 1104 is configured to tightly receive a standard threaded socket (see 2300) such that the interior surface makes contact with the outer surface of the threads. In an embodiment, the polygonal socket connector 1100 provides a tight compression fitting with the socket such that the polygonal socket connector 1100 is secure and will not move if the lamp is bumped or shifted.

The exterior surface 1110 includes a first tapered fitting 1102. In an embodiment as illustrated in FIGS. 11-14, the first tapered fitting 1102 comprises a plurality of sides 1112, 1114 having a tapered shape or angle. In an embodiment, the first tapered fitting 1102 includes six long tapered sides 1114 and six short tapered sides 1112. In an embodiment, the first tapered fitting 1102 includes six tapered sides 1114 and six tapered corners 1112 such that the first tapered fitting 1102 comprises a hexagonal shape. In various embodiments, the first tapered fitting 1102 comprises any of a triangular shape, a square shape, a rectangular shape, a pentagonal shape, a hexagonal shape, a heptagonal shape, an octagonal shape, a nonagonal shape, and a decagonal shape. It should be appreciated that the first tapered fitting 1102 may comprise any suitable shape including any suitable polygonal shape.

The tapered side 1112, 1114 is configured to provide a secure compression fitting with the polygonal bracket 1500. It should be appreciated that the plurality of tapered sides 1112, 1114 can be particularly suited to forming a highly secure and stable compression fitting that prevents a lampshade from wobbling on a lamp base, and so forth. In an embodiment, the tapered sided 1112, 1114 tapers outward from top to bottom as illustrated in FIG. 11. In an embodiment, the tapered side 1112, 1114 tapers inward from top to bottom (not illustrated). In an embodiment, the tapered side 1112, 1114 is constructed of any suitably rigid material, including plastic, metal, wood, and so forth. In an embodiment, the tapered side 1112, 1114 includes a smooth surface or it may alternatively include a rough or bumpy surface, or it may alternatively include a threaded surface.

The channel 1106 is a cutout disposed in the sleeve 1104. The channel 1106 is configured to receive and abut an electrical fitting of a lamp socket, such as a knob, a turn, a button, and so forth that may be configured to actuate the lamp. In an embodiment, a top surface of the electrical fitting abuts the top service of the channel 1106. In an embodiment, there exists two channels 1106 located opposite one another and each disposed in the sleeve 1104.

The sleeve 1104 of the polygonal socket connector 1100 is configured to receive and encompass a lamp socket. In an embodiment, the sleeve 1104 includes a cylindrical shape and is configured to receive a standard threaded lamp socket or a standard smooth lamp socket. In an embodiment, the sleeve 1104 is constructed of any suitably rigid material, including plastic, metal, wood and so forth. In an embodiment, the polygonal socket connector 1100 comprises a single piece of a suitably rigid material and the socket 1104 is fully connected to the first tapered fitting 1102. In an embodiment, the sleeve 1104 and the first tapered fitting 1102 are constructed separately and are removably attached to one another. In an embodiment, a plurality of sleeves 1104 or a plurality of first tapered fittings 1102, or a plurality of each may be provided to a user such that the user may select the appropriate sleeve 1104 and the appropriate first tapered fitting 1102 for a particular lamp. In an embodiment, the polygonal socket connector 1100 is configured to be retrofitted to a plurality of different lamps, including a plurality of varying lamp sockets and lampshades.

In an embodiment, the polygonal socket connector 1100 serves as a retrofit socket connector that can accommodate a plurality of sockets. The sleeve 1104 can be configured to receive a smooth non-threaded socket 2200 or a threaded socket 2300. In an embodiment, the sleeve 1104 tightly receives a threaded socket 2300 and rests over the threads without engaging with each individual thread. In an embodiment, the sleeve 1104 is threaded at the interior such that it engages with the threaded socket 2300.

Figure 15:
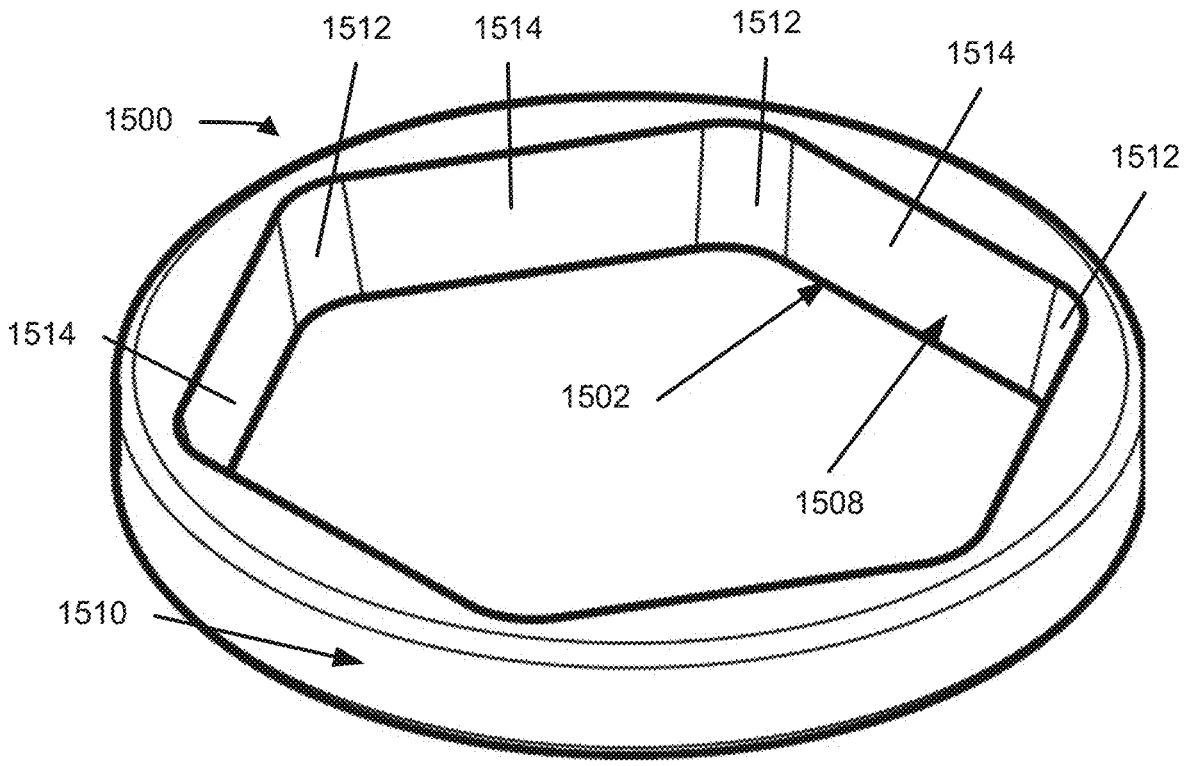
FIG. 15 is a perspective view illustrating a polygonal bracket, according to one embodiment.
Figure 16:
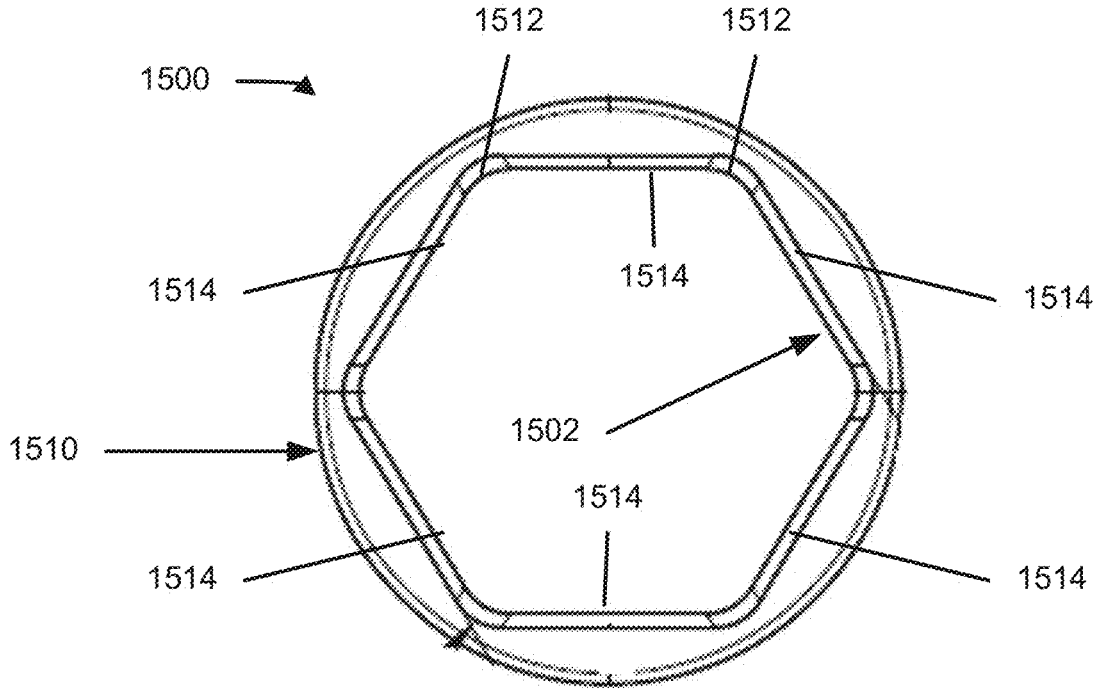
FIG. 16 is an aerial view illustrating a polygonal bracket, according to one embodiment.
Figure 17:
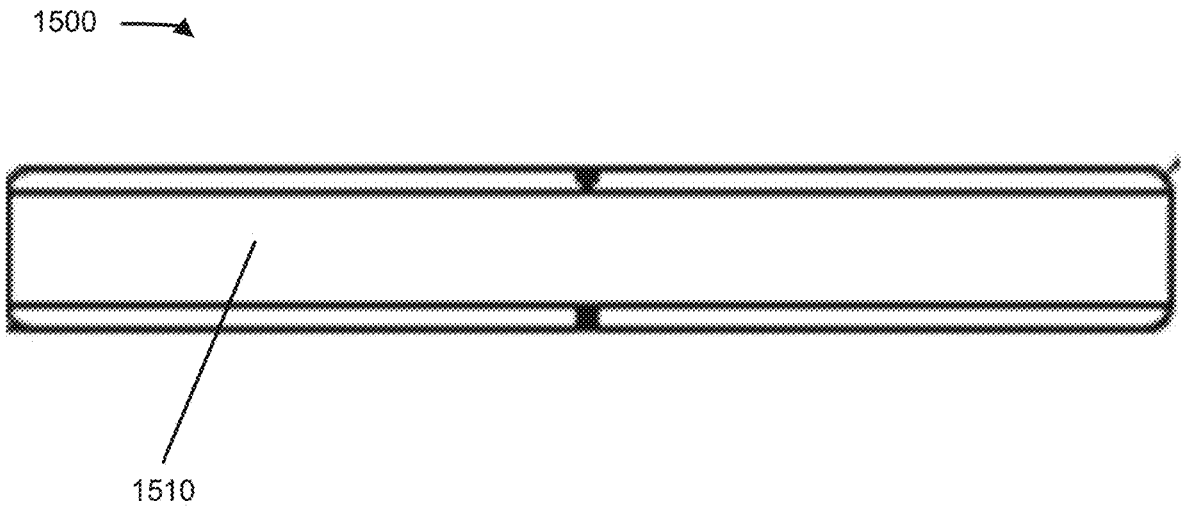
FIG. 17 is a front view illustrating a polygonal bracket, according to one embodiment.
Figure 18:
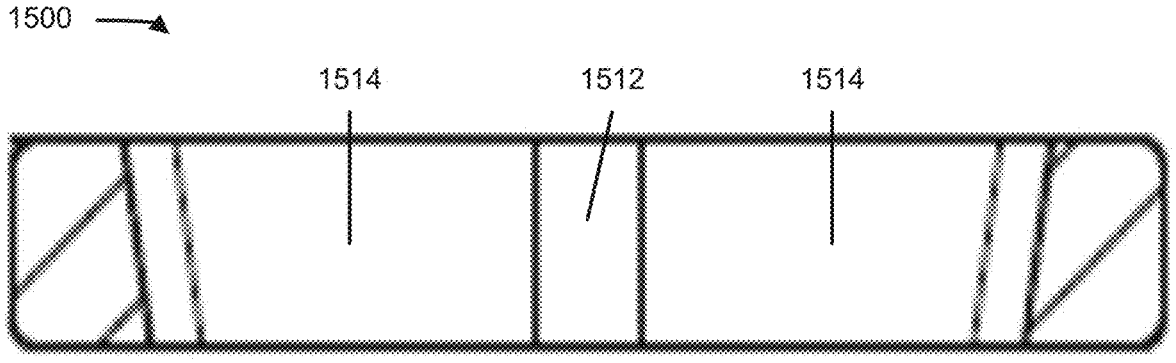
FIG. 18 is a cross-section view illustrating a polygonal bracket, according to one embodiment.

FIGS. 15-18 illustrate various views of a polygonal bracket 1500, according to one embodiment. FIG. 15 illustrates a perspective view, FIG. 16 illustrates an aerial view, FIG. 17 illustrates a front/side view, and FIG. 18 illustrates a cutaway front/side view wherein one-half of the polygonal bracket 1500 is cutaway and an interior of the polygonal bracket 1500 is illustrated. The polygonal bracket 1500 includes an interior surface 1508 and an exterior surface 1510. The polygonal bracket 1500 includes a second tapered fitting 1502 disposed about the interior surface 1508. In an embodiment, the second tapered fitting 1502 includes a plurality of tapered sides 1512, 1514 having a tapered shape or angle.

The second tapered fitting 1502 corresponds with the first tapered fitting 1102 such that the polygonal socket connector 1100 and the polygonal bracket 1500 form a secure compression fitting. The polygonal bracket 1500 is configured to be received by and placed on to the polygonal socket connector 1100. In an embodiment, the polygonal socket connector 1100 is connected to or resting on a lamp socket and the polygonal bracket 1500 may be depressed on to the polygonal socket connector 1100 such that the devices 1100, 1500 form a secure compression fitting. In an embodiment, the second tapered fitting 1502 includes six long tapered sides 1514 and six short tapered sides 1512. In an embodiment, the second tapered fitting 1502 includes six tapered sides 1514 and six tapered corners 1512 such that the second tapered fitting 1502 comprises a hexagonal shape. In various embodiments, the second tapered 1502 comprises any of a triangular shape, a square shape, a rectangular shape, a pentagonal shape, a hexagonal shape, a heptagonal shape, an octagonal shape, a nonagonal shape, and a decagonal shape. It should be appreciated that the second tapered fitting 1502 may comprise any suitable shape including any suitable polygonal shape.

The tapered side 1512, 1514 of the plurality of sides is configured to provide a secure compression fitting with the polygonal socket connector 1100. It should be appreciated that the plurality of tapered sides 1512, 1514 can be particularly suited to forming a highly secure and stable compression fitting that prevents a lampshade from wobbling on a lamp base, and so forth. In an embodiment, the tapered side 1512, 1514 tapers inward from top to bottom as illustrated in FIG. 15 such that the circumference at a top end (as pictured) is greater than the circumference at the bottom end (as pictured). In an embodiment, the opposite is true wherein the tapered side 1512, 1514 tapers outward from top to bottom (not illustrated) such that the circumference at a top end is smaller than a circumference at a bottom end. In an embodiment, the tapered side 1512, 514 is constructed of any suitably rigid material, including plastic, metal, wood, and so forth. In an embodiment, the tapered side 1512, 1514 includes a smooth surface or it may alternatively include a rough or bumpy surface, or it may alternatively include a threaded surface.

In an embodiment, a lampshade is attached to the polygonal bracket 1500. The lampshade may be removably attached or permanently secured to the polygonal bracket 1500. In an embodiment, the polygonal bracket 1500 is secured or configured to be secured to a harp of the lampshade. In such an embodiment, when the polygonal bracket 1500 forms a compression fitting with the polygonal socket connector 1100, the polygonal bracket 1500 may thereby securely support and hold the lampshade atop a lamp base. In an embodiment, the polygonal bracket 1500 is configured to be retrofitted to any lampshade, such that the lampshade may be attached to the polygonal bracket 1500 and may thereby be connected to the polygonal socket connector 1100. In such an embodiment, the polygonal socket connector 1100 may further comprise a standard size and shape such that it may be connected to or may rest upon any standard socket known in the art. In an embodiment, the polygonal bracket 1500 is integrated with the lampshade such that the polygonal bracket 1500 forms part of the lampshade fitting and is configured to form a compression fitting with a polygonal socket connector 1100 on any suitable lamp base.

Figure 19:
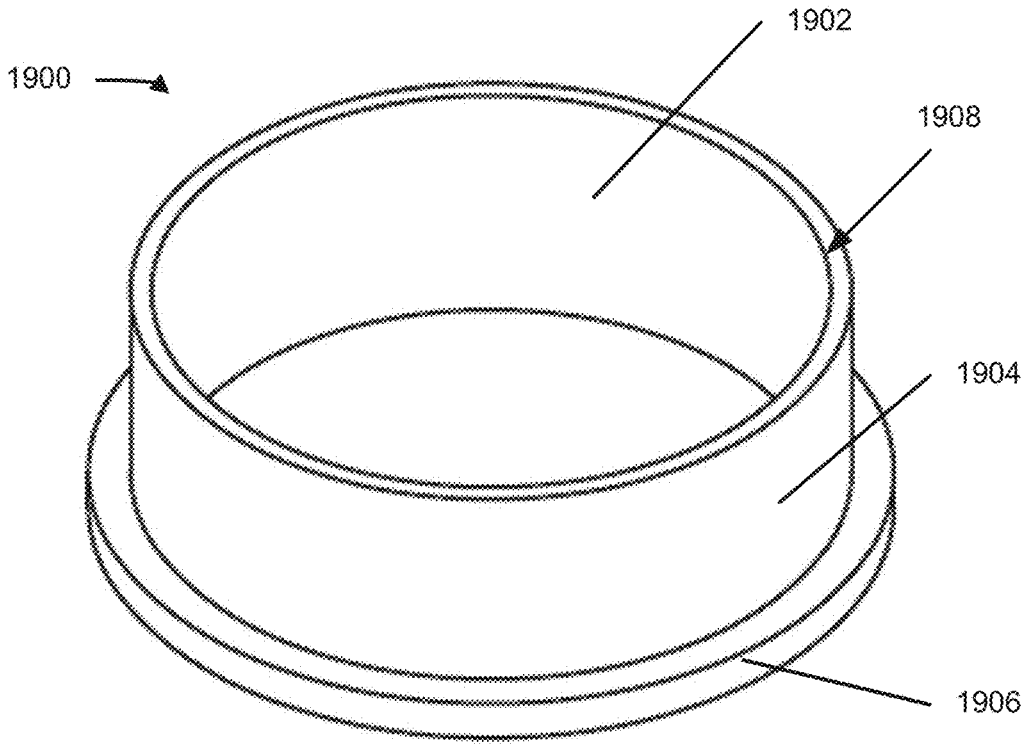
FIG. 19 is a perspective view of a socket sleeve, according to one embodiment.
Figure 20:
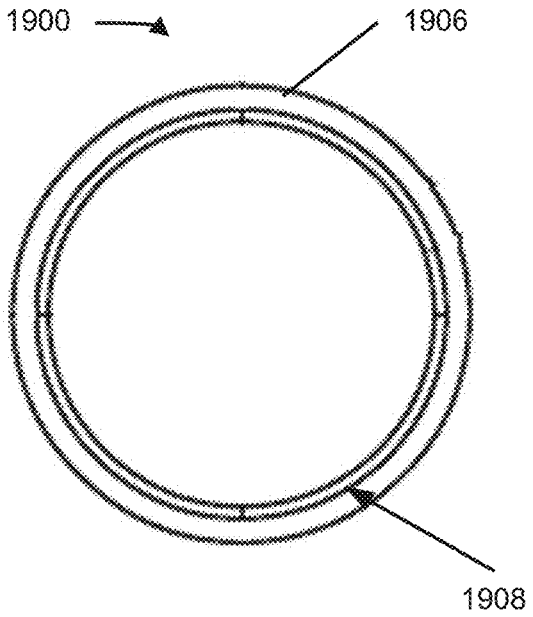
FIG. 20 is an aerial view of a socket sleeve, according to one embodiment.
Figure 21:
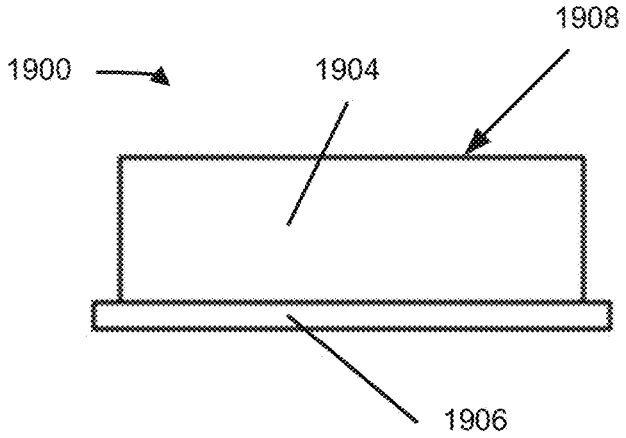
FIG. 21 is a front view of a socket sleeve, according to one embodiment.

FIGS. 19-21 illustrate various view of a socket sleeve 1900, according to one embodiment. FIG. 19 illustrates a perspective view, FIG. 20 illustrates an aerial view, and FIG. 21 illustrates a front/side view. The socket sleeve 1900 is configured to receive and/or form a secure connection with a socket. In an embodiment, the socket sleeve 1900 comprises a size and shape configured to receive and form a compression fitting with a standard non-threaded socket (see 2200). Standard non-threaded sockets typically have a smaller diameter and circumference than threaded sockets (2300) known in the art. In an embodiment, the polygonal socket connector 1100 comprises a greater diameter and circumference than the socket sleeve 1900, and the polygonal socket connector 1100 is configured to receive and/or form a secure connection with a threaded socket 2300. In such an embodiment, the socket sleeve 1900 is configured to receive and/or form a secure connection with a non-threaded socket 2200 and is further configured to form a secure compression fitting between the outer surface 1904 of the socket sleeve 1900 and the inner surface 1108 of the polygonal socket connector 1100. That is, in such an embodiment, the socket sleeve 1900 can serve as a retrofit device that enables the polygonal socket connector 1100 to be used with a non-threaded socket.

The socket sleeve 1900 includes an exterior surface 1904 and an interior surface 1902. The socket sleeve 1900 comprises a sleeve 1908 configured to receive and form a secure connection with a standard non-threaded socket 2200. The socket sleeve 1900 further includes a ridge 1906 disposed about the exterior surface 1904. The ridge 1906 may be configured to rest on an exterior ridge disposed about a socket and it may further be configured to rest on a bottom of a socket, or a top of a lamp base. In an embodiment, the size and shape of the interior surface 1902 is configured to receive and form a secure connection with a non-threaded socket. In an embodiment, the size and shape of the exterior surface 1904 is configured to be received by, and to form a secure connection with, the interior surface 1108 of the polygonal socket connector 1100. In an embodiment, the size and shape of the interior surface 1108 of the polygonal socket connector 1100 is configured to receive either of a threaded socket or the socket sleeve 1900. That is, the socket sleeve 1900 may be configured as a retrofit to permit the polygonal socket connector 1100 to perform a secure connection with either of a threaded or non-threaded socket, wherein the socket sleeve 1900 is required only in the case of a non-threaded socket.

The socket sleeve 1900 is constructed of any suitable rigid material including for example, plastic, metal, wood and so forth. In an embodiment the socket sleeve 1900 comprises a smooth or mostly smooth surface and in an alternative embodiment the socket sleeve 1900 comprises a rough, textured, or bumpy surface. In an embodiment, the socket sleeve 1900 comprises threading that may be configured to interact with threading on a polygonal socket connector 1100. In an embodiment, the socket sleeve 1900 comprises a circular or elliptical shape. In an embodiment, the socket sleeve 1900 comprises a polygonal shape. In an embodiment, the socket sleeve 1900 comprises a tapered shape on either of the interior surface, the exterior surface, or both the interior surface and the exterior surface.

Figure 22:
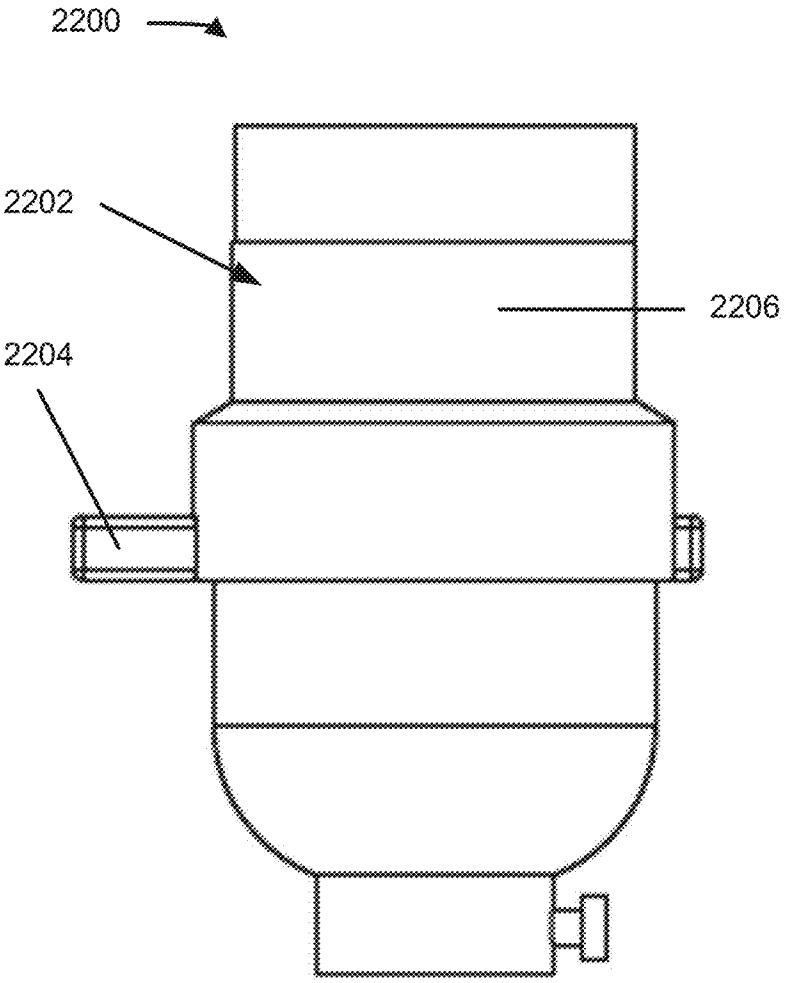
FIG. 22 is a front view of a lamp socket, according to one embodiment.

FIG. 22 illustrates a side/front view of a non-threaded socket 2200, according to one embodiment. The non-threaded socket 2200 includes a smooth surface 2202 and may include interior threading that is not visible from the outside of the socket 2200. The non-threaded socket 2200 includes an electrical fitting 2204 such as knob, button, or pull configured to activate or deactivate a lamp. The non-threaded socket 2200 includes an exterior surface 2206. In an embodiment, either of the socket sleeve 1900 or the polygonal socket connector 1100 is configured to receive and form a secure connection with the exterior surface 2206 of the non-threaded socket 2200.

Figure 23:
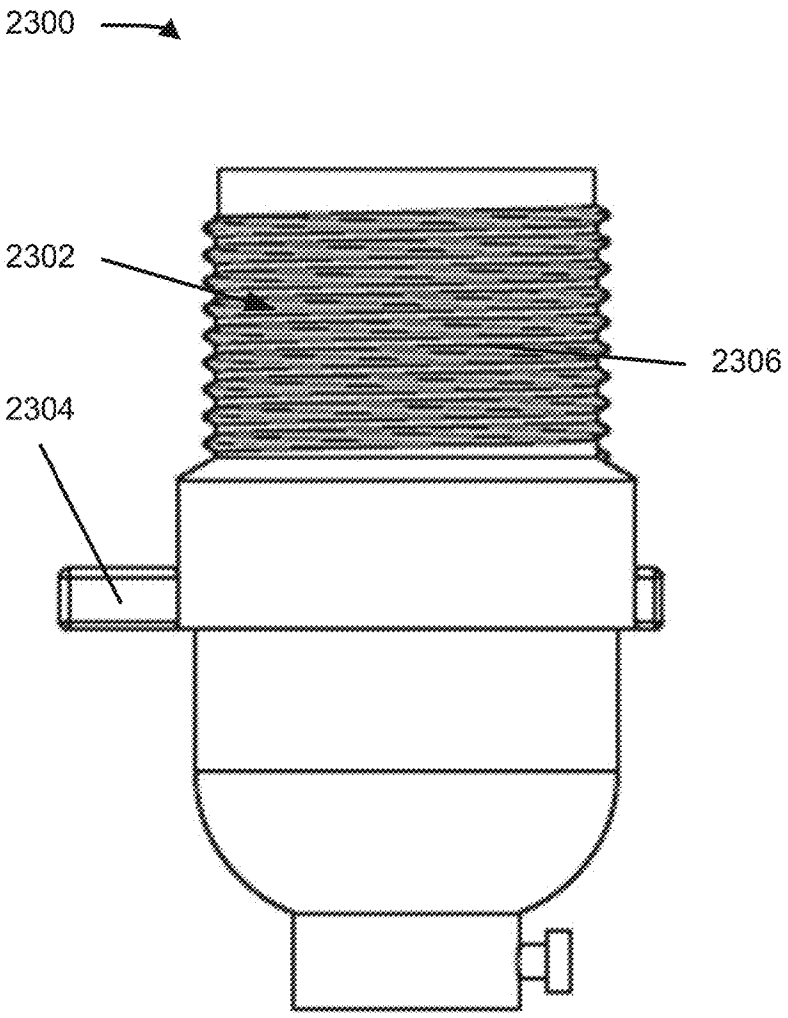
FIG. 23 is a front view of a threaded lamp socket, according to one embodiment.

FIG. 23 illustrates a side-front view of a threaded socket 2300, according to one embodiment. The threaded socket 2300 includes an electrical fitting 2304 such as knob, button, or pull configured to activate or deactivate a lamp. The threaded socket 2300 includes an exterior surface 2306. In an embodiment, either of the socket sleeve 1900 or the polygonal socket connector 1100 is configured to receive and form a secure connection with the exterior surface 2206 of the non-threaded socket 2200. The threaded socket 2300 further includes a plurality of threads 2302 disposed about an exterior surface 2306 of the socket 2300.

Figure 24:
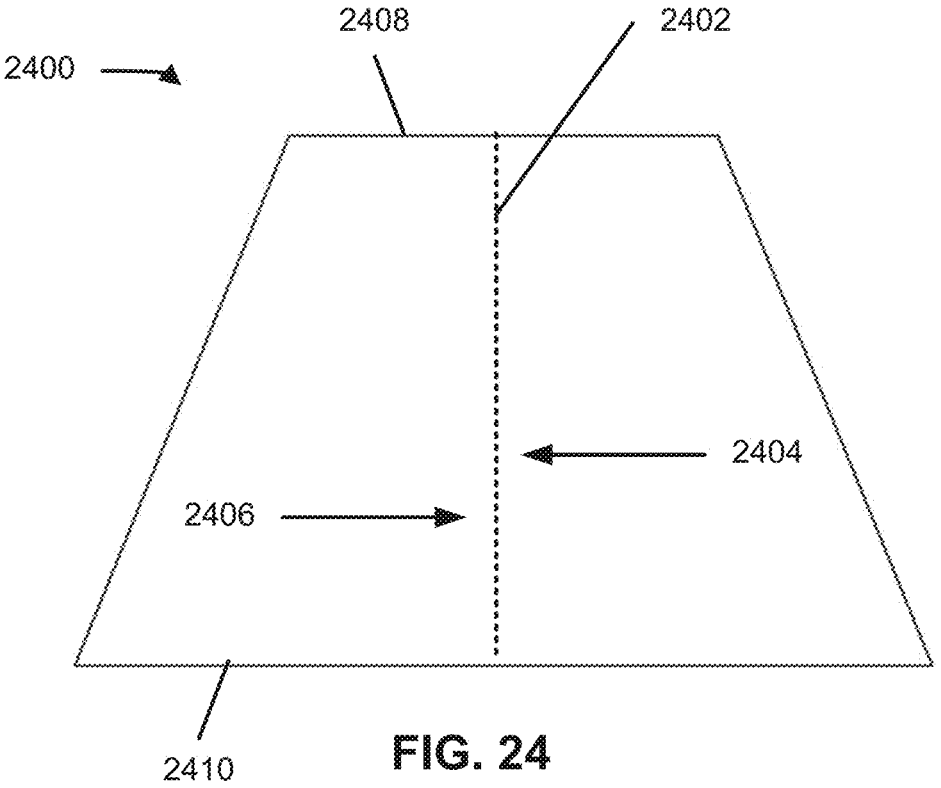
FIG. 24 is a front view of an inner shade of a lampshade system, according to one embodiment.
Figure 25:
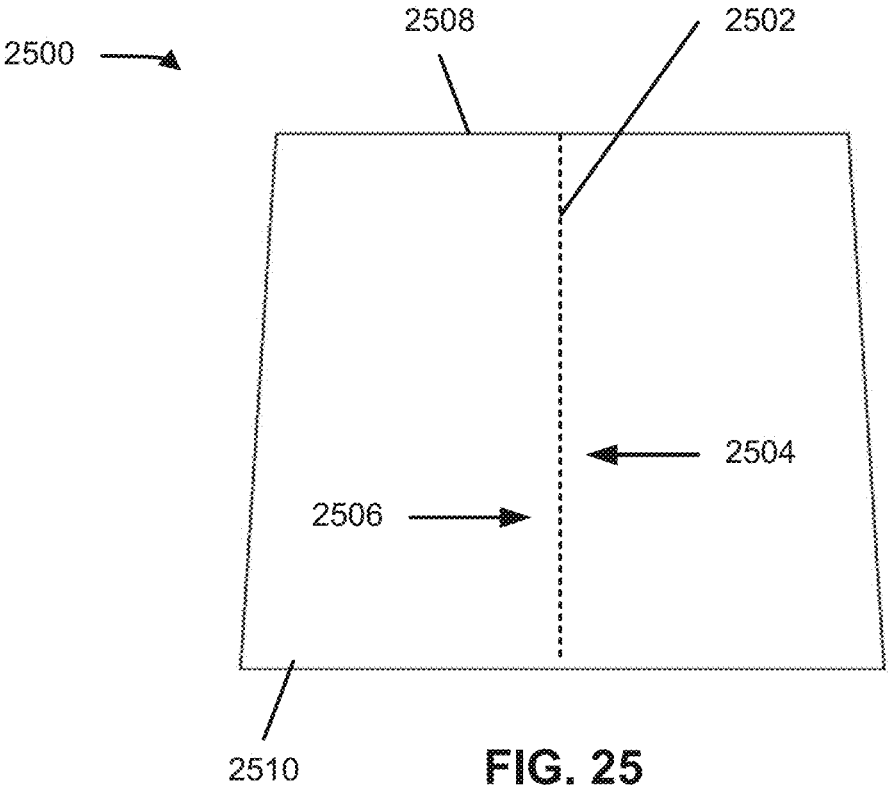
FIG. 25 is a front view of an inner shade of a lampshade system, according to one embodiment.

FIGS. 24-25 illustrate front/side views of various embodiments of lampshade inner shades 2400, 2500. As illustrated in FIG. 24, an inner shade 2400 includes a seam 2402 where a first end 2404 and a second end 2406 meet. In an embodiment the seam 2402 does not include any fastener and the first end 2402 and the second end 2406 are held next to each other only via tension as a result of being held within an outer shade 2600 (see e.g. FIG. 27). In various embodiments the inner shade 2400 is shaped as shown in FIG. 24 and includes a fastener attaching the first end 2404 to the second 2406 either removably or permanently. The inner shade 2400 includes a first side 2408 and a second side 2410. The first side 2408 and the second side 2410 may alternatively be referred to as a top side and a bottom side, or a top rim and a bottom rim, respectfully. In an embodiment the inner shade 2400 is constructed of a single piece that is configured to bend as illustrated in FIGS. 3-4 and 7-9.

As illustrated in FIG. 25, an inner shade 2500 includes a seam 2502 where a first end 2504 and a second end 2506 meet. In an embodiment the seam 2502 does not include any fastener and the first end 2504 and the second end 2506 are held next to each other only via tension as disclosed in FIG. 26 below. The inner shade 2500 includes a first side 2508 and a second side 2510. In an embodiment the inner shade 2500 is constructed of a single piece that is configured to bend as illustrated in FIGS. 3-4 and 7-9. In an embodiment, the shape of the inner shade 2500 is disposed within an outer shade 2600 (see FIG. 26) and the inner shade 2500 assumes the shape of the outer shade 2600 via tension only (see e.g. FIG. 27).

Figure 26:
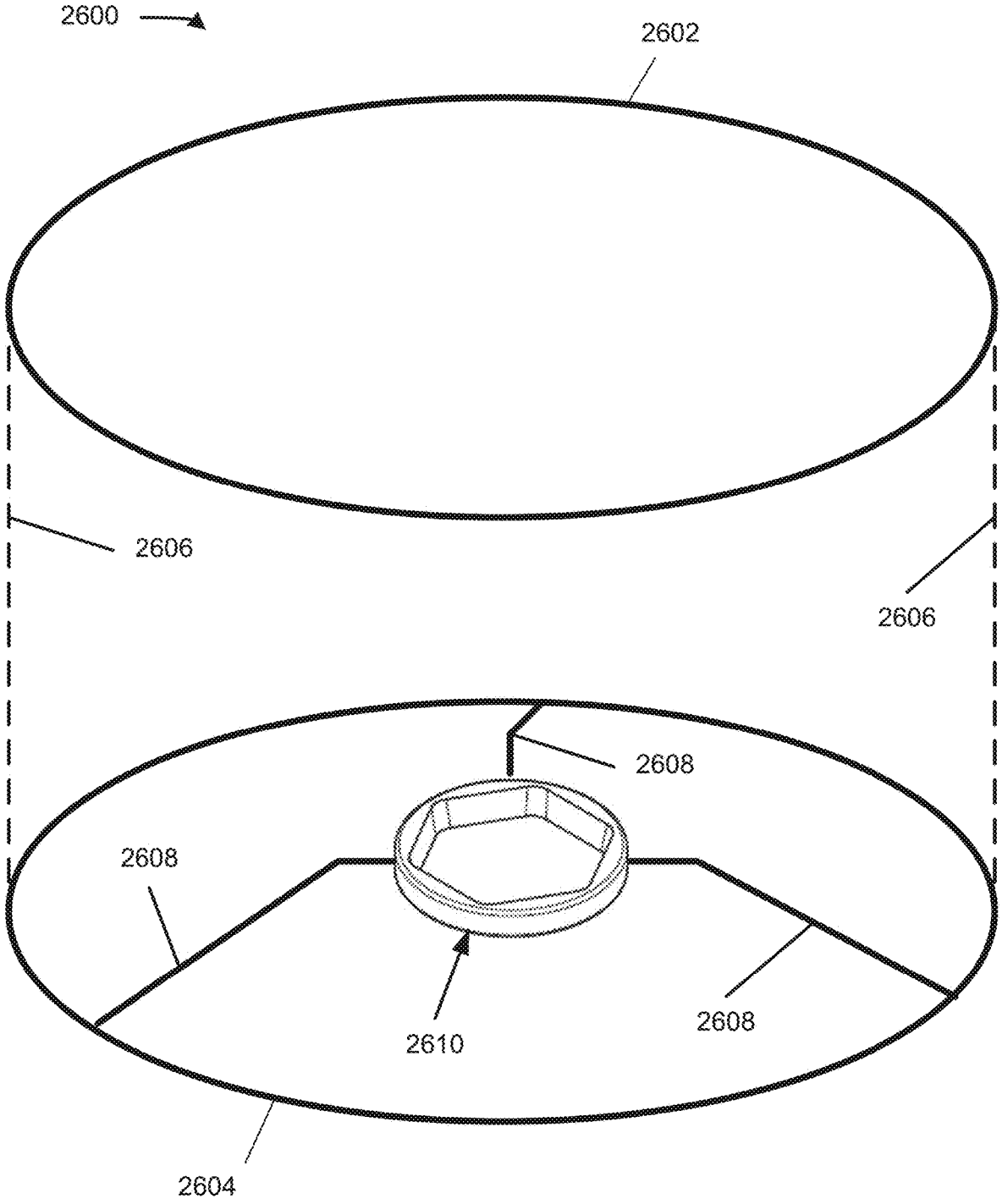
FIG. 26 is a perspective view of an outer shade of a lampshade system, according to one embodiment.

FIG. 26 illustrates a perspective view of an outer shade 2600 of a lampshade system. The outer shade 2600 includes a polygonal bracket 2610 like the polygonal bracket disclosed in FIGS. 15-18. The outer shade 2600 includes a first frame 2602 disposed about a first perimeter of a lampshade. The outer shade 2600 includes a second frame 2604 disposed about a second perimeter of the lampshade. The outer shade 2600 comprises a first end (or upper end) of a structural side 2606 attached to the first frame 2602 and a second end (or lower end) of the structural side 2606 attached to the second frame 2604. The structural side 2606 connecting the first frame 2602 and the second frame 2604 can be seen as dotted lines as illustrated where the structural side 2606 is transparent. The structural side 2606 comprises a shape matching that of the first frame 2602 and the second frame 2604 and is disposed about the circumference of the outer shade 2600. The outer shade 2600 includes one or more structural members 2608 configured to secure the polygonal bracket 2610 to one or more of the second frame 2604 or the first frame 2602 (structural members are not secured to the first frame 2602 as shown in FIG. 26).

The structural side 2606 connects the first frame 2602 to the second frame 2604 and supports the first frame 2602 above the second frame 2604 in an embodiment. The structural side may be constructed of a transparent semi-rigid or rigid material. In alternative embodiments, the structural side may be constructed of a translucent material. In an embodiment the structural side 2606 is constructed such that an inner shade 2400, 2500 may be disposed within the outer shade 2600 and the inner shade 2400, 2500 may be seen through the structural side 2606 of the outer shade 2600.

In an embodiment the outer shade 2600 includes the structural side 2606 configured to hold an inner shade 2400, 2500 via tension only. In such an embodiment a user may utilize an outer shade 2600 along with one or more removable lampshade inner shades (see e.g. FIGS. 3-4, 7-9, and 24-25) such that the removable lampshade inner shade may be disposed about an interior surface of the structural side 2606 of the outer shade 2600. The user may have various inner shades (the removable shade) having a variety of colors and designs, and the user may replace the inner shades to reflect different seasons or aesthetic preferences. In such an embodiment the outer shade 2600 is constructed of a transparent or semitransparent material and the outer shade 2600 serves to hold the inner shade in place via tension. In such an embodiment the outer shade 2600 is permanently affixed to the polygonal bracket 2610 via the structural members 2608 and the appearance of the lampshade is changed with the inner shade. In an embodiment, the inner shade is constructed and shaped such that the inner shade is configured to bend to a curvature that matches an interior surface curvature of the structural side 2606 of the outer shade 2600. In such an embodiment the inner shade 2400, 2500 may "spring" into a shape that fills the entire inner curvature of the outer shade 2600 and causes the inner shade 2400, 2500 to be held in place within the outer shade 2600 only via tension. In alternative embodiments the inner shade may be affixed at the seam (see 2402, 2502) or it may not include any fastener and may only be held in the proper shape (see for example FIGS. 24-25) via tension caused by the shapes of the inner shade and the outer shade 2600.

In an embodiment the first frame 2602 and the second frame 2604 are each constructed of a rigid material and form a standard lampshade shape such as an ellipse, a square, a rectangle, and so forth. In various embodiments the perimeter of the first frame 2602 may be less than or greater than the perimeter of the second frame 2604. In a particular embodiment, the perimeter of the first frame 2602 is less than the perimeter of the second frame 2604 such that the outer shade 2600 forms a standard lampshade shape. In an embodiment, each of the first frame 2602 and the second frame 2604 comprises a circular shape, an elliptical shape, a rectangular shape, a square shape, and so forth. It should be appreciated that the shape of the first frame 2602 and the second frame 2604 may be any suitable shape that may have a desirable aesthetic appearance for a lampshade. In an embodiment as illustrated in FIG. 26, the first frame 2602 and the second frame 2604 are not connected by an additional structural rod or other structural member but are only connected by the structural side 2606. In such an embodiment the structural side 2606 may be constructed of a rigid plastic material or other suitable alternative. In an alternative embodiment, there are one or more vertical structural rods or members connecting the first frame 2602 to the second frame 2604 and providing additional structural support to the outer shade 2600. In various embodiments, either of the first frame 2602 and the second frame 2604 may further include a lip or ridge configured to permit an inner shade 2400, 2500 to abut against and/or rest against the lip or ridge and further configured to stabilize the positioning of the inner shade within the outer shade 2600.

In an embodiment the structural members 2608 are constructed of any suitably rigid material and are configured to secure the polygonal bracket 2610 to the second frame 2604 (as shown) or the first frame 2602, or each of the second frame 2604 and the first frame 2602. In an embodiment, each of the first frame 2602, the second frame 2604, the polygonal bracket 2610, and the one or more structural members 2608 are molded of the same rigid material such as a metal, a plastic, a wood, and so forth.

In an embodiment as illustrated in FIG. 26, the polygonal bracket 2610 includes a tapered fitting configured to match an additional tapered fitting on a polygonal socket connector 1100 (see FIGS. 11-14). In such an embodiment, the polygonal socket connector 1100 may form a secure compression fitting with a lamp socket 2200, 2300 (attached to a lamp base), the polygonal socket connector 1100 and the polygonal bracket 2610 may form a secure compression fitting with one another, and the outer shade 2600 may be securely attached to the polygonal bracket 2610. In such an embodiment the outer shade 2600 is securely connected to a lamp base via the polygonal bracket 2610 and a polygonal socket connector 1100.

Figure 27:
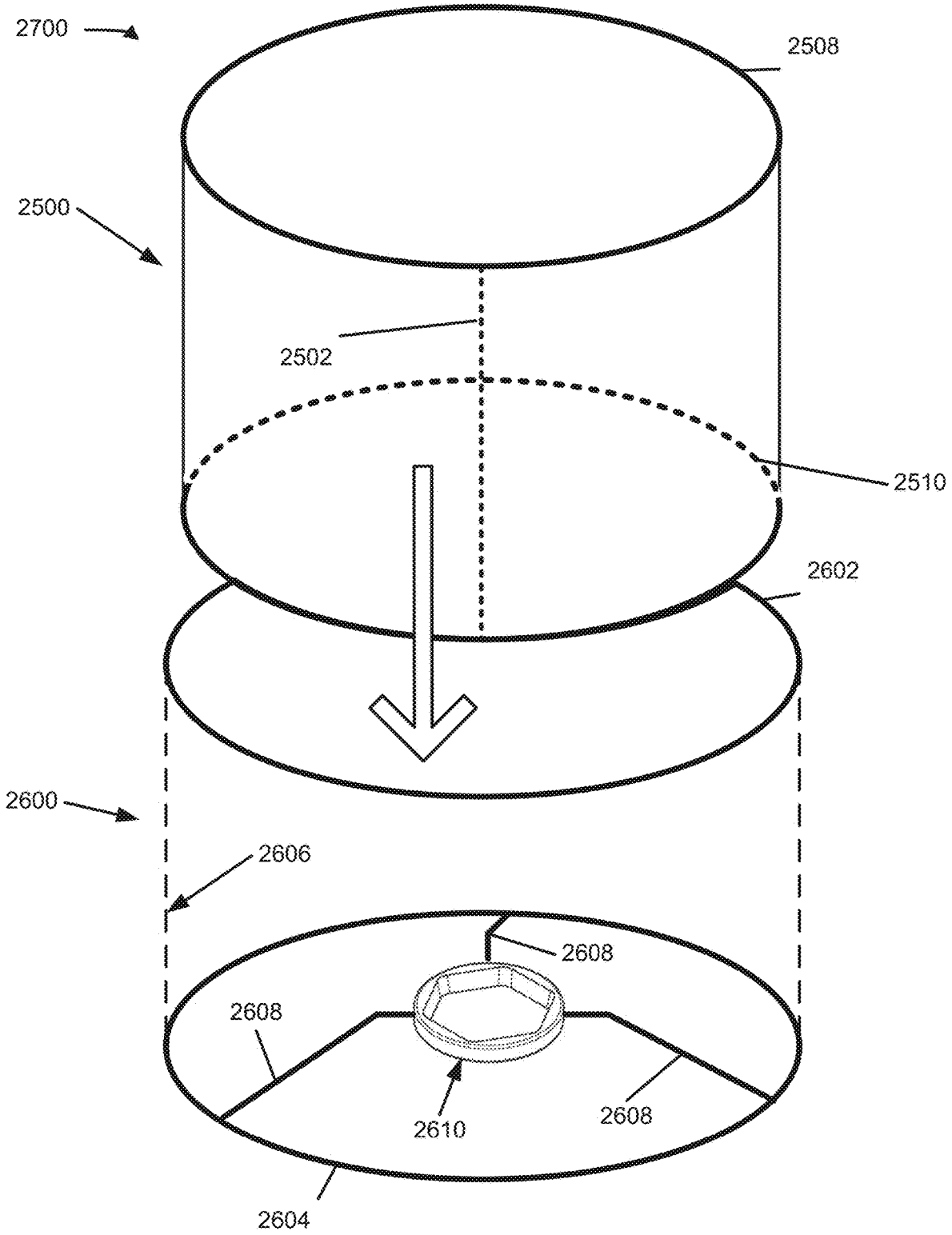
FIG. 27 is an exploded perspective view of an inner shade and an outer shade of a lampshade system, according to one embodiment.

FIG. 27 illustrates a lampshade system 2700 including an inner shade 2500 and an outer shade 2600. The lampshade system 2700 is configured to be attached to a lamp base to provide an aesthetically pleasing lampshade with a removable and interchangeable inner shade 2500. As illustrated in FIG. 27, the inner shade 2500 is configured to be placed down within the outer shade 2600 and is configured to be disposed within the outer shade 2600. In an embodiment, the inner shade 2500 includes a flexible material and is configured to "spring" outward when disposed against the structural side 2606 of the outer shade 2600. In an embodiment, an outer surface of the inner shade 2500 abuts against an inner surface of the structural side 2606 of the outer shade 2600. In an embodiment, the first side 2508 of the inner shade 2500 aligns with the first frame 2606 of the outer shade 2600. In an embodiment, the second side 2510 of the inner shade 2600 aligns with the second frame 2604 of the outer shade 2600. In an embodiment, the second side 2510 of the inner shade 2500 rests against a lip disposed within the second frame 2604 of the outer shade 2600. In an embodiment, each of the first frame 2602 and the second frame 2604 of the outer shade 2600 includes a lip or crevice wherein the first side 2508 or the second side 2510 of the inner shade may abut, be secured to, or be disposed within.

In an embodiment as disclosed in FIG. 27, the outer shade 2600 includes a polygonal bracket 2610 secured to one or more of the first frame 2602 or the second frame 2605 of the outer shade 2600. The polygonal bracket 2610 (see the alternative embodiment 1500) is configured to secure the lampshade system 2700 to a lamp base via one or more of the polygonal socket connector 1100, the socket sleeve 1900, and the socket 2200, 2300.

In an embodiment, the seam 2502 of the inner shade 2500 indicates where a first end 2502 and a second end 2506 of the inner shade 2500 meet. In an embodiment, the seam 2502 includes a fastener of some sort. In an embodiment, the seam 2502 does not include any fastener and the inner shade 2500 is held into the appropriate shape only via tension when it is disposed within the outer shade 2600. In an embodiment, the outer shade 2600 includes a transparent or semi-transparent structural side 2606 and the inner shade 2500 is constructed of any variety of aesthetically appealing colors or patterns suitable for a lampshade.

Figure 28:
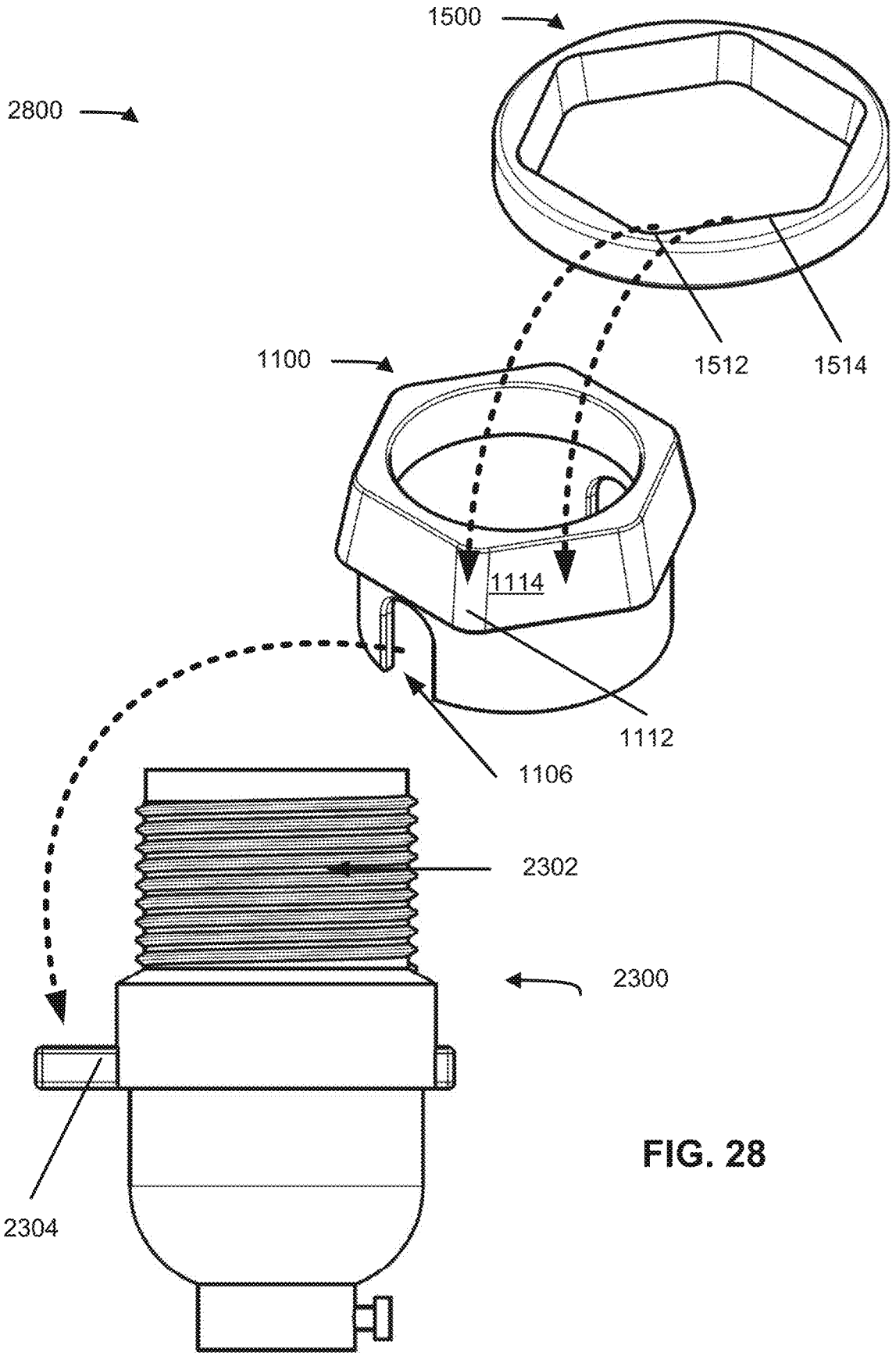
FIG. 28 is an exploded perspective view of a lamp fitting apparatus system, according to one embodiment.

FIG. 28 illustrates an exploded view of a lamp fitting system 2800. The system 2800 includes a threaded socket 2300, a polygonal socket connector 1100, and a polygonal bracket 1500. The threaded socket 2300 includes a plurality of threads 2302 disposed about an exterior surface of the threaded socket 2300. As illustrated in FIG. 28, the channel 1106 of the polygonal socket connector 1100 is configured to rest on and/or be disposed about the electrical fitting 2304 of the threaded socket 2300. In an embodiment, a circumference of an inner surface of the polygonal socket connector 1100 matches a maximum circumference of the exterior surface of the plurality of threads 2302 of the threaded socket 2300. In such an embodiment, the polygonal socket connector 1100 forms a secure compression fitting with the threaded socket 2300. The polygonal bracket 1500 is configured to be depressed on to and disposed about the polygonal socket connector 1100. The tapered sides 1512, 1514 of the polygonal bracket 1500 are configured to form a compression fitting with the tapered sides 1112, 1114 of the polygonal socket connector 1100. The polygonal bracket 1500 and the polygonal socket connector 1100 form a secure compression fitting with each other. The polygonal socket connector 1100 and the threaded socket 2300 form a secure compression fitting with each other. The polygonal bracket 1500 may be secured to an outer shade 2600 as illustrated in FIGS. 26-27, and as such the polygonal bracket 1500 may secure the outer shade 2600 to the threaded socket 2300 of a lamp base via the polygonal socket connector 1100.

Figure 29:
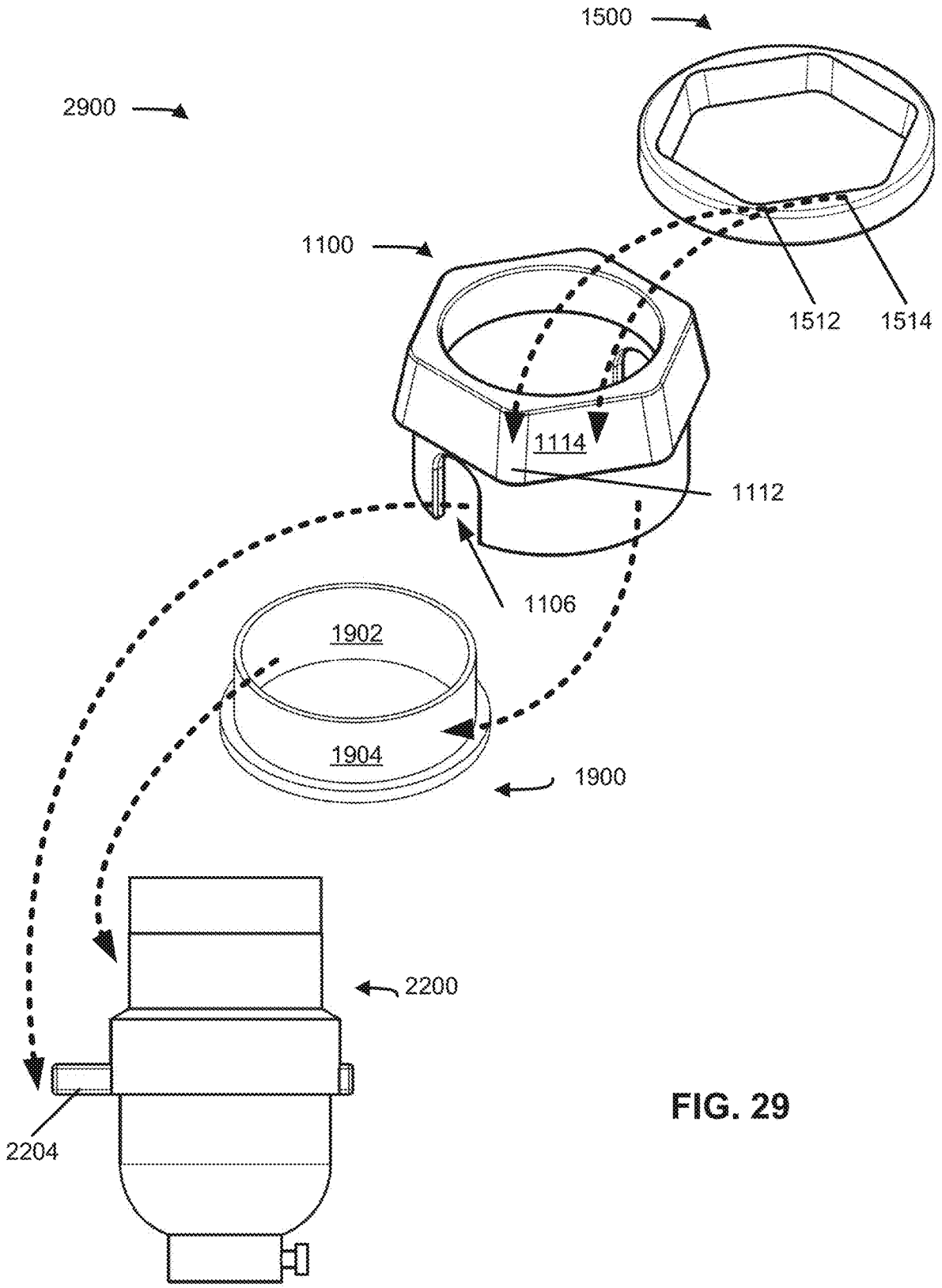
FIG. 29 is an exploded perspective view of a lamp fitting apparatus system, according to one embodiment.

FIG. 29 illustrates an exploded view of a lamp fitting system 2900. The system includes a non-threaded socket 2200, a socket sleeve 1900, a polygonal socket connector 1100, and a polygonal bracket 1500. The non-threaded socket 2200 has an exterior surface. The socket sleeve 1900 includes an exterior surface 1904 and an interior surface 1902. The interior surface 1902 of the socket sleeve 1900 is configured to be disposed about the exterior surface of the non-threaded socket 2200. In an embodiment, the circumference of the interior surface 1902 of the socket sleeve 1900 matches the circumference of the exterior surface of the non-threaded socket 2200 such that the socket sleeve 1900 forms a secure compression fitting with the non-threaded socket 2200. The polygonal socket connector 1100 is configured to be depressed on to and disposed about the socket sleeve 1900. An interior surface of the polygonal socket connector 1100 is configured to be disposed about the exterior surface 1904 of the socket sleeve 1900. The channel 1106 of the polygonal socket connector 1100 is configured to rest on and/or be disposed about the electrical fitting 2204 of the non-threaded socket 2200. The polygonal bracket 1500 is configured to be depressed onto and disposed about the polygonal socket connector 1100. The tapered sides 1512, 1514 of the polygonal bracket 1500 are configured to form a secure compression fitting with the tapered sides 1112, 1114 of the polygonal socket connector 1100. In an embodiment as illustrated in FIGS. 26-27, the polygonal bracket 1500 is attached to an outer shade 2600. In such an embodiment, the polygonal bracket 1500 is configured to attach the outer shade 2600 to a lamp base having a socket (2200 or 2300) in conjunction with the polygonal socket connector 1100 and the socket sleeve 1900.2400

EXAMPLES

The following examples pertain to further embodiments.

Example 1 is a method for manufacturing a lampshade cover. The method includes feeding a planar sheet of plastic material to a printer. The method includes printing a design for one or more lampshade covers on the planar sheet of plastic material using the printer. The method includes die cutting the planar sheet to create one or more cut-out portions shaped to be bent, folded, or rolled into a three-dimensional lampshade cover shape. The cut-out portions including at least a portion of the design printed using the printer. The method includes attaching a fastener to a first end and a second end for selectively fastening the first end to the second end to hold the cut-out portions in the three-dimensional lampshade cover shape.

In Example 2, the attaching the fastener to the first end and the second end includes as in Example 1 includes attaching the fastener directly to one or more of the first end and the second end using a glue or adhesive.

In Example 3, the attaching the fastener to the first end and the second end as in any of Examples 1-2 includes attaching magnetic tape to the first end or the second end.

In Example 4, the printing as in any of Examples 1-3 includes printing the design using an ultraviolet ink or powder and curing the ultraviolet ink or powered using an ultraviolet light source.

In Example 5, the ink or powder as in Example 4 includes a glow-in-the-dark ink or powder.

In Example 6, the printing as in any of Examples 1-5 includes lenticular printing on the planar sheet of plastic material to create a design including a holographic design.

In Example 7, the printing as in any of Examples 1-6 includes three-dimensional printing to add material to form a three-dimensional shape on the planar sheet of plastic material.

In Example 8, the planar sheet of plastic material as in any of Examples 1-7 includes a semi-rigid material that retains its shape when bent, folded, or rolled into the lampshade cover shape.

In Example 9, the design of any of Examples 1-8 is visible when the lampshade cover is in the lamp-shade cover shape.

In Example 10, the planar sheet as in any of Examples 1-9 is at least semi-transparent, wherein printing includes printing on an interior surface, and wherein when the cut-out portion is in the lampshade cover shape, the design on the interior of the lampshade cover shape is visible through the planar sheet from an exterior of the lampshade cover shape.

Example 11 is a lampshade cover prepared by a process including feeding a planar sheet of plastic material to a printer. The process includes printing a design for one or more lampshade covers on the planar sheet of plastic material using the printer. The process includes die cutting the planar sheet to create one or more cut-out portions shaped to be bent, folded, or rolled into a three-dimensional lampshade cover shape, the cut-out portions including at least a portion of the design printed using the printer. The process includes attaching a fastener to a first end and a second end to for selectively fastening the first end to the second end to form a three-dimensional lampshade cover shape.

In Example 12, the attaching the fastener to the first end and the second end as in Example 11 includes attaching the fastener directly to one or more of the first end and the second end using a glue or adhesive.

In Example 13, the printing as in any of Examples 11-12 includes printing the design using an ultraviolet ink or powder and curing the ultraviolet ink or powered using an ultraviolet light source.

In Example 14, the ink or powder of Example 13 includes glow in the dark ink or powder.

In Example 15, the printing as in any of Examples 11-14 includes lenticular printing on the planar sheet of plastic material to create a design including a holographic design.

In Example 16, the printing as in any of Examples 11-15 includes three-dimensional printing to add material to form a three-dimensional shape on the planar sheet of plastic material.

In Example 17, the planar sheet of plastic material as in any of Examples 11-16 includes one or more of styrene or polypropylene having a thickness greater than about 0.25 millimeters.

In Example 18, the planar sheet of plastic material as in any of Examples 11-17 includes a semi-rigid material that retains its shape when bent, folded, or rolled into the lampshade cover shape.

In Example 19, the planar sheet as in any of Examples 11-18 is at least semi-transparent, wherein printing in the process includes printing on an interior surface, and wherein when the cut-out portion is in the lampshade cover shape, the design on the interior surface of the lampshade cover shape is visible from an exterior of the lampshade cover shape.

In Example 20, the process as in any of Examples 11-19 further includes rolling up the cut-out-portion and storing in cylindrical tube.

Example 21 is a lampshade system a lampshade cover and a support member. The lampshade cover includes a sheet of plastic material including a first end and a second end. The lampshade cover includes a design printed on the plastic material. The lampshade cover includes a fastener configured to selectively fasten a first end of the sheet to a second end of the sheet to hold the lampshade cover in a three-dimensional lampshade shape, wherein the design is exposed for viewing when the lampshade cover is in the lampshade shape. The support member is configured to selectively receive and support the lampshade cover relative to a lamp body, the support member including one or more arms extending from the lamp body.

In Example 22, the support member as in Example 21 includes a transparent lampshade having a shape matching at least a portion of an inside of the three-dimensional lampshade shape to allow the lampshade cover to rest on and around the transparent lampshade while allowing light to pass through the transparent lampshade.

In Example 23, the support member as in any of Examples 21-22 includes a circular ring including a groove to selectively receive and support a lower edge of the lampshade cover when the fastener is secured to hold the lampshade cover when it is in the three-dimensional lampshade shape.

In Example 24, the groove of Example 21 is formed between a transparent lampshade and a lip extending from a lower edge of the transparent lampshade.

In Example 25, the one or more arms extending from the lamp body as in any of Examples 21-24 are positioned even with or below a top of a light source of a lamp mounted to the lamp body to avoid creating shadows above the light source.

In Example 26, the design as in any of Examples 21-25 is printed on an interior of the lampshade cover when the lampshade cover in the three-dimensional lampshade shape, wherein the sheet includes at least partially transparent material to allow the design to be seen from an exterior of the lampshade cover.

In Example 27, the fastener as in any of Examples 21-26 includes magnetic tape attached to the first end or the second end.

In Example 28, the lampshade cover as in any of Examples 21-27 is flexible to be rolled into a storage configuration.

Example 29 is a packaged lampshade cover. The packaged lampshade cover includes a lampshade cover that includes a sheet of plastic material including a first end and a second end. The lampshade cover includes a design printed on the plastic material. The lampshade cover includes a fastener configured to selectively fasten a first end of the sheet to a second end of the sheet to hold the lampshade cover in a three-dimensional lampshade shape, wherein the design is exposed for viewing when the lampshade cover is in the lampshade shape. The lampshade cover is selectively configurable into a lampshade shape and a storage configuration, wherein the fastener is released, and the lampshade cover is rolled up in the storage configuration. The packaged lampshade cover includes a container and the lampshade cover is in the storage configuration within the container.

In Example 30, the lampshade cover of Example 29 is removable from the container.

In Example 31, the design as in any of Examples 29-30 includes a design printed using ultraviolet ink or powder.

In Example 32, the ink or powder as of Example 31 includes glow in the dark ink or powder.

In Example 33, the design as in any of Examples 29-32 includes a lenticular printed design including a holographic design.

In Example 34, the design as in any of Examples 29-33 includes a three-dimensional printed design printed using an additive printing process.

In Example 35, the sheet of plastic material as in any of Examples 29-34 includes a substantially uniform thickness greater than about 0.25 millimeters.

In Example 36, the sheet of plastic material as in any of Examples 29-35 includes a substantially uniform thickness, the thickness including from about 0.25 millimeters to about 0.55 millimeters.

In Example 37, the sheet of plastic material as in any of Examples 29-36 includes a substantially uniform thickness, the thickness including from about 0.35 millimeters to about 0.45 millimeters.

In Example 38, the sheet of plastic material as in any of Examples 29-37 includes a semi-rigid material that retains its shape when bent, folded, or rolled into the lampshade cover shape.

In Example 39, the sheet of plastic material as in any of Examples 29-38 is semi-transparent, wherein the design is printed on an interior surface, and wherein when the lampshade cover is in the lampshade cover shape, the design on the interior surface of the lampshade cover shape is visible through the sheet from an exterior of the lampshade cover shape.

Example 40 is a lamp fitting apparatus. The lamp fitting apparatus includes a polygonal socket connector comprising a first tapered fitting, wherein the polygonal socket connector is configured to connect with a lamp socket; and a polygonal bracket comprising a second tapered fitting, wherein the polygonal bracket is configured to attach to a lampshade. The lamp fitting apparatus is such that the second tapered fitting of the polygonal bracket corresponds with the first tapered fitting of the polygonal socket connector, such that the polygonal bracket and the polygonal socket connector form a compression fitting configured to secure the lampshade to the lamp socket.

Example 41 is a lamp fitting apparatus as in Example 40, further comprising a socket sleeve. The socket sleeve comprises: an interior surface configured to abut an exterior surface of the lamp socket; and a ridge configured to abut an exterior ridge of the lamp socket. The socket sleeve is such that an interior surface of the polygonal socket connector is configured to form a compression fitting with an exterior surface of the socket sleeve.

Example 42 is a lamp fitting apparatus as in any of Examples 40-41, wherein the first tapered fitting is disposed about an exterior surface of the polygonal socket connector.

Example 43 is a lamp fitting apparatus as in any of Examples 40-42, wherein the polygonal socket connector comprises a plurality of sides, and wherein a tapered side is formed on one or more sides of the plurality of sides to form the first tapered fitting.

Example 44 is a lamp fitting apparatus as in any of Examples 40-43, wherein the polygonal socket connector comprises a plurality of sides, and wherein a tapered side is formed on each side of the plurality of sides to form the first tapered fitting.

Example 45 is a lamp fitting apparatus as in any of Examples 40-44, wherein the polygonal socket connector further comprises a sleeve and wherein the sleeve comprises a non-tapered side.

Example 46 is a lamp fitting apparatus as in any of Examples 40-45, wherein the polygonal socket connector further comprises a channel disposed in the sleeve of the polygonal socket connector, wherein the channel is configured to abut an electrical fitting of the lamp socket.

Example 47 is a lamp fitting apparatus as in any of Examples 40-46, wherein the sleeve of the polygonal socket connector is configured to form a tight connection with an exterior surface of the lamp socket.

Example 48 is a lamp fitting apparatus as in any of Examples 40-47, wherein the first tapered fitting of the polygonal socket connector comprises six sides, and wherein each side of the six sides comprises a tapered side.

Example 49 is a lamp fitting apparatus as in any of Examples 40-48, wherein the second tapered fitting is disposed about an interior surface of the polygonal bracket.

Example 50 is a lamp fitting apparatus as in any of Examples 40-49, wherein the polygonal bracket comprises a plurality of sides, and wherein a tapered side is formed on one or more sides of the plurality of sides to form the second tapered fitting.

Example 51 is a lamp fitting apparatus as in any of Examples 40-50, wherein the polygonal bracket comprises a plurality of sides, and wherein a tapered side is formed on each side of the plurality of sides to form the second tapered fitting.

Example 52 is a lamp fitting apparatus as in any of Examples 40-51, wherein the second tapered fitting of the polygonal bracket comprises size sides, and wherein each side of the six sides comprises a tapered side.

Example 53 is a lamp fitting apparatus as in any of Examples 40-52, wherein the first tapered fitting is disposed about an exterior surface of the polygonal socket connector and the second tapered fitting is disposed about an interior surface of the polygonal bracket, and wherein the compression fitting is formed when the polygonal bracket is disposed about the polygonal socket connector.

Example 54 is a lamp fitting apparatus as in any of Examples 40-53, wherein the polygonal bracket is configured to be secured to a harp of the lampshade.

Example 55 is a lamp system. The lamp system includes a polygonal socket connector comprising a first tapered fitting, wherein the polygonal socket connector is configured to connect with a lamp socket; and a lampshade comprising a polygonal bracket, wherein the polygonal bracket comprises a second tapered fitting. The system is such that the second tapered fitting of the polygonal bracket corresponds with the first tapered fitting of the polygonal socket connector, such that the polygonal bracket and the polygonal socket connector form a compression fitting configured to secure the lampshade to the lamp socket.

Example 56 is a lamp system as in Example 55, further comprising a socket sleeve. The socket sleeve comprises: an interior surface configured to connect with an exterior surface of the lamp socket; and a ridge configured to abut an exterior ridge of a lamp base. The lamp system is such that an interior surface of the polygonal socket connector is configured to form a compression fitting with an exterior surface of the socket sleeve.

Example 57 is a lamp system as in any of Examples 55-56, wherein the polygonal socket connector is configured to connect with a lamp socket comprising external threading disposed about an external surface of the lamp socket.

Example 58 is a lamp system as in any of Examples 55-57, wherein the socket sleeve is configured to connect with a lamp socket comprising a non-threaded external surface such that the external surface of the lamp socket is approximately smooth.

Example 59 is a lamp system as in any of Examples 55-58, wherein the first tapered fitting is disposed about an exterior surface of the polygonal socket connector and the second tapered fitting is disposed about an interior surface of the polygonal bracket, and wherein the compression fitting is formed when the polygonal bracket is disposed about the polygonal socket connector.

Example 60 is a lampshade system. The lampshade system includes an outer shade comprising: a first frame disposed about a first perimeter of the outer shade; a second frame disposed about a second perimeter of the outer shade; and a structural side comprising a first side attached to the first frame and a second side attached to the second frame. The lampshade system includes an inner shade configured to be disposed about an interior surface of the structural side of the outer shade; and a socket component configured to attach the outer shade to a lamp socket, wherein the socket component is attached to one or more of the first frame of the outer shade or the second frame of the outer shade.

Example 61 is a system as in Example 60, wherein the inner shade comprises a single piece having a first end and a second end, wherein the single piece of the inner shade is configured to bend to a curvature matching an interior surface curvature of the structural side of outer shade such that the first end meets the second end.

Example 62 is a system as in any of Examples 60-61, wherein the inner shade comprises a shape causing the inner shade to be disposed about the interior surface of the outer shade via tension.

Example 63 is a system as in any of Examples 60-62, wherein the shape of the inner shade causes the inner shade to be disposed about the interior surface of the structural side of the outer shade only via tension and the inner shade does not further comprise a fastener securing the first end to the second end.

Example 64 is a system as in any of Examples 60-63, wherein the structural side of the outer shade comprises a transparent or semitransparent material.

Example 65 is a system as in any of Examples 60-64, wherein the first perimeter of the outer shade is smaller than the second perimeter of the outer shade.

Example 66 is a system as in any of Examples 60-65, further comprising a polygonal socket connector comprising a first tapered fitting, wherein the polygonal socket connector is configured to connect with a lamp socket.

Example 67 is a system as in any of Examples 60-66, wherein the socket component is a polygonal bracket comprising a second tapered fitting, wherein the second tapered fitting of the polygonal bracket corresponds with the first tapered fitting of the polygonal socket connector, such that the polygonal bracket and the polygonal socket connector form a compression fitting configured to connect the outer shade to the lamp socket.

Example 68 is a system as in any of Examples 60-67, wherein the polygonal socket connector is configured to be securely disposed about a standard lamp socket such that the polygonal socket connector permits the socket component and the lampshade to be connected to any lamp base having the standard lamp socket.

Example 69 is a system as in any of Examples 60-68, further comprising one or more structural members configured to secure the socket component to one or more of the first frame or the second frame, wherein the one or more structural members extend radially from the socket component to the one or more of the first frame or the second frame.

Example 70 is a system as in any of Examples 60-69, wherein one or more of the first perimeter or the second perimeter comprises an elliptical shape.

Example 71 is a system. The system includes a polygonal socket connector comprising a first tapered fitting, wherein the polygonal socket connector is configured to connect with a lamp socket. The system includes an outer shade comprising: a first frame disposed about a first perimeter of the outer shade; a second frame disposed about a second perimeter of the outer shade; and a structural side comprising a first side attached to the first frame and a second side attached to the second frame. The system includes a polygonal bracket comprising a second tapered fitting, wherein the polygonal bracket is attached to one or more of the first frame of the outer shade or the second frame of the outer shade. The system is such that the second tapered fitting of the polygonal bracket corresponds with the first tapered fitting of the polygonal socket connector, such that the polygonal bracket and the polygonal socket connector form a compression fitting configured to connect the outer shade to the lamp socket.

Example 72 is a system as in Example 71, wherein the inner shade comprises a single piece having a first end and a second end, wherein the single piece of the inner shade is configured to bend to a curvature matching an interior surface curvature of the structural side of the outer shade such that the first end meets the second end.

Example 73 is a system as in any of Example 71-72, wherein the inner shade comprises a shape causing the inner shade to be disposed about the interior surface of the structural side of the outer shade via tension.

Example 74 is a system as in any of Example 71-73, wherein the shape of the inner shade causes the inner shade to be disposed about the interior surface of the structural side of the outer shade only via tension and the inner shade does not further comprise a fastener securing the first end to the second end.

Example 75 is a system as in any of Example 71-74, wherein the structural side of the outer shade comprises a transparent or semitransparent material.

Example 76 is a system as in any of Example 71-75, wherein the first perimeter of the outer shade is smaller than the second perimeter of the outer shade.

Example 77 is a system as in any of Example 71-76, further comprising one or more structural members configured to secure the polygonal bracket to the one or more of the first frame or the second frame of the outer shade, wherein the one or more structural members extend radially from the polygonal bracket to the one or more of the first frame or the second frame of the outer shade.

Example 78 is a system as in any of Example 71-77, wherein one or more of the first perimeter or the second perimeter comprises an elliptical shape.

Example 79 is a system as in any of Example 71-78, further comprising a socket sleeve, wherein the socket sleeve comprises: an interior surface configured to connect with an exterior surface of the lamp socket; and a ridge configured to abut an exterior ridge of the lamp socket or a lamp base; wherein an interior surface of the polygonal socket connector is configured to form a compression fitting with an exterior surface of the socket sleeve.

Various techniques, or certain aspects or portions thereof, may take the form of program code (i.e., instructions) embodied in tangible media, such as floppy diskettes, CD-ROMs, hard drives, a non-transitory computer readable storage medium, or any other machine readable storage medium wherein, when the program code is loaded into and executed by a machine, such as a computer, the machine becomes an apparatus for practicing the various techniques. In the case of program code execution on programmable computers, the computing device may include a processor, a storage medium readable by the processor (including volatile and non-volatile memory and/or storage elements), at least one input device, and at least one output device. The volatile and non-volatile memory and/or storage elements may be a RAM, an EPROM, a flash drive, an optical drive, a magnetic hard drive, or another medium for storing electronic data. One or more programs that may implement or utilize the various techniques described herein may use an application programming interface (API), reusable controls, and the like. Such programs may be implemented in a high-level procedural or an object-oriented programming language to communicate with a computer system. However, the program(s) may be implemented in assembly or machine language, if desired. In any case, the language may be a compiled or interpreted language, and combined with hardware implementations.

Many of the functional units described in this specification may be implemented as one or more components, which is a term used to more particularly emphasize their implementation independence. For example, a component may be implemented as a hardware circuit comprising custom very large-scale integration (VLSI) circuits or gate arrays, off-the-shelf semiconductors such as logic chips, transistors, or other discrete components. A component may also be implemented in programmable hardware devices such as field programmable gate arrays, programmable array logic, programmable logic devices, or the like.

Components may also be implemented in software for execution by various types of processors. An identified component of executable code may, for instance, comprise one or more physical or logical blocks of computer instructions, which may, for instance, be organized as an object, a procedure, or a function. Nevertheless, the executables of an identified component need not be physically located together but may comprise disparate instructions stored in different locations that, when joined logically together, comprise the component and achieve the stated purpose for the component.

Indeed, a component of executable code may be a single instruction, or many instructions, and may even be distributed over several different code segments, among different programs, and across several memory devices. Similarly, operational data may be identified and illustrated herein within components and may be embodied in any suitable form and organized within any suitable type of data structure. The operational data may be collected as a single data set or may be distributed over different locations including over different storage devices, and may exist, at least partially, merely as electronic signals on a system or network. The components may be passive or active, including agents operable to perform desired functions.

Reference throughout this specification to "an example" means that a particular feature, structure, or characteristic described in connection with the example is included in at least one embodiment of the present disclosure. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present disclosure may be referred to herein along with alternatives for the various components thereof. It is understood that such embodiments, examples, and alternatives are not to be construed as de facto equivalents of one another but are to be considered as separate and autonomous representations of the present disclosure.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive.

Those having skill in the art will appreciate that many changes may be made to the details of the above-described embodiments without departing from the underlying principles of the disclosure. The scope of the present disclosure should, therefore, be determined only by the following claims.

The invention claimed is:

1. A lamp fitting apparatus comprising:

a polygonal socket connector comprising a first tapered fitting, wherein the polygonal socket connector is configured to connect with a lamp socket; and a polygonal bracket comprising a second tapered fitting, wherein the polygonal bracket is configured to attach to a lampshade;

wherein the second tapered fitting of the polygonal bracket corresponds with the first tapered fitting of the polygonal socket connector, such that the polygonal bracket and the polygonal socket connector form a compression fitting configured to connect the lampshade to the lamp socket;

wherein the polygonal socket connector comprises a plurality of sides, and wherein a tapered side is formed on one or more sides of the plurality of sides to form the first tapered fitting.

2. The lamp fitting apparatus of claim 1, further comprising a socket sleeve, wherein the socket sleeve comprises:

an interior surface configured to abut an exterior surface of the lamp socket; and a ridge configured to abut an exterior ridge of the lamp socket or a lamp base;

wherein an interior surface of the polygonal socket connector is configured to form a compression fitting with an exterior surface of the socket sleeve.

3. The lamp fitting apparatus of claim 1, wherein the first tapered fitting is disposed about an exterior surface of the polygonal socket connector.

4. The lamp fitting apparatus of claim 1, wherein the polygonal socket connector comprises a plurality of sides, and wherein a tapered side is formed on each side of the plurality of sides to form the first tapered fitting.

5. The lamp fitting apparatus of claim 1, wherein the polygonal socket connector further comprises a sleeve and wherein the sleeve comprises a non-tapered side.

6. The lamp fitting apparatus of claim 5, wherein the polygonal socket connector further comprises a channel disposed in the sleeve of the polygonal socket connector, wherein the channel is configured to abut an electrical fitting of the lamp socket.

7. The lamp fitting apparatus of claim 5, wherein the sleeve of the polygonal socket connector is configured to form a tight connection with an exterior surface of the lamp socket.

8. The lamp fitting apparatus of claim 1, wherein the first tapered fitting of the polygonal socket connector comprises six sides, and wherein each side of the six sides comprises a tapered side.

9. The lamp fitting apparatus of claim 1, wherein the second tapered fitting is disposed about an interior surface of the polygonal bracket.

10. The lamp fitting apparatus of claim 1, wherein the polygonal bracket comprises a plurality of sides, and wherein a tapered side is formed on one or more sides of the plurality of sides to form the second tapered fitting.

11. The lamp fitting apparatus of claim 1, wherein the polygonal bracket comprises a plurality of sides, and wherein a tapered side is formed on each side of the plurality of sides to form the second tapered fitting.

12. The lamp fitting apparatus of claim 1, wherein the second tapered fitting of the polygonal bracket comprises size sides, and wherein each side of the six sides comprises a tapered side.

13. The lamp fitting apparatus of claim 1, wherein the first tapered fitting is disposed about an exterior surface of the polygonal socket connector and the second tapered fitting is disposed about an interior surface of the polygonal bracket, and wherein the compression fitting is formed when the polygonal bracket is disposed about the polygonal socket connector.

14. The lamp fitting apparatus of claim 1, wherein the polygonal bracket is configured to be secured to a harp of the lampshade.

15. A lamp system comprising:

a polygonal socket connector comprising a first tapered fitting, wherein the polygonal socket connector is configured to connect with a lamp socket; and a lampshade comprising a polygonal bracket, wherein the polygonal bracket comprises a second tapered fitting;

wherein the second tapered fitting of the polygonal bracket corresponds with the first tapered fitting of the polygonal socket connector, such that the polygonal bracket and the polygonal socket connector form a compression fitting configured to connect the lampshade to the lamp socket;

wherein the polygonal socket connector comprises a plurality of sides, and wherein a tapered side is formed on one or more sides of the plurality of sides to form the first tapered fitting.

16. The lamp system of claim 15, further comprising a socket sleeve, wherein the socket sleeve comprises:

an interior surface configured to connect with an exterior surface of the lamp socket; and a ridge configured to abut an exterior ridge of a lamp base;

wherein an interior surface of the polygonal socket connector is configured to form a compression fitting with an exterior surface of the socket sleeve.

17. The lamp system of claim 15, wherein the polygonal socket connector is configured to connect with a lamp socket comprising external threading disposed about an external surface of the lamp socket.

18. The lamp system of claim 16, wherein the socket sleeve is configured to connect with a lamp socket comprising a non-threaded external surface such that the external surface of the lamp socket is approximately smooth.

19. The lamp system of claim 15, wherein the first tapered fitting is disposed about an exterior surface of the polygonal socket connector and the second tapered fitting is disposed about an interior surface of the polygonal bracket, and wherein the compression fitting is formed when the polygonal bracket is disposed about the polygonal socket connector.

* * * * *